US012320556B2

(12) United States Patent
Kumakura et al.

(10) Patent No.: US 12,320,556 B2
(45) Date of Patent: Jun. 3, 2025

(54) AIR CONDITIONER

(71) Applicant: DAIKIN INDUSTRIES, LTD., Osaka (JP)

(72) Inventors: Eiji Kumakura, Osaka (JP); Atsushi Yoshimi, Osaka (JP); Takuro Yamada, Osaka (JP); Ikuhiro Iwata, Osaka (JP); Takeru Miyazaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 230 days.

(21) Appl. No.: 17/957,738

(22) Filed: Sep. 30, 2022

(65) Prior Publication Data

US 2023/0027378 A1 Jan. 26, 2023

Related U.S. Application Data

(63) Continuation of application No. PCT/JP2021/013191, filed on Mar. 29, 2021.

(30) Foreign Application Priority Data

Mar. 31, 2020 (JP) ..... 2020-062742

(51) Int. Cl.

| | |
|---|---|
| ***F25B 13/00*** | (2006.01) |
| ***F25B 9/00*** | (2006.01) |
| ***F25B 41/40*** | (2021.01) |

(52) U.S. Cl.

CPC ..... *F25B 13/00* (2013.01); *F25B 9/008* (2013.01); *F25B 41/40* (2021.01); *F25B 2309/061* (2013.01)

(58) Field of Classification Search

CPC .. F25B 2400/23; F25B 9/08; F25B 2309/061; F25B 9/008; F25B 41/40; F25B 13/00;

(Continued)

(56) References Cited

FOREIGN PATENT DOCUMENTS

| | | |
|---|---|---|
| EP | 3263374 A1 | 1/2018 |
| JP | 2006-234263 A | 9/2006 |

(Continued)

OTHER PUBLICATIONS

International Search Report issued in corresponding International Application No. PCT/JP2021/013191 mailed Apr. 27, 2021 (5 pages).

(Continued)

*Primary Examiner* — Cassey D Bauer

(74) *Attorney, Agent, or Firm* — Osha Bergman Watanabe & Burton LLP

(57) ABSTRACT

An air conditioner includes: a heat-source-side unit including a compressor and a heat-source-side heat exchanger; use-side units each including a use-side heat exchanger; an intermediate unit that causes the use-side heat exchanger of each of the use-side units to individually function as an evaporator or a radiator of a refrigerant; and two connection pipes that each connect the heat-source-side unit and the intermediate unit. The intermediate unit includes: an ejector that is configured to pressurize the refrigerant evaporated in the use-side heat exchanger that functions as the evaporator by using a driving flow; and a gas-liquid separator into which the refrigerant flowing out from the ejector flows.

9 Claims, 11 Drawing Sheets

(58) Field of Classification Search
CPC ..... F25B 29/003; F25B 5/00–504; F25B 2341/0012; F25B 2341/0014
USPC ..... 62/500
See application file for complete search history.

(56) References Cited

FOREIGN PATENT DOCUMENTS

| | | | | |
|---|---|---|---|---|
| JP | 2016070595 | A | 5/2016 | |
| JP | 2016070596 | A | 5/2016 | |
| WO | WO-2016180482 | A1 * | 11/2016 | ..... F25B 1/10 |

OTHER PUBLICATIONS

Written Opinion issued in corresponding International Application No. PCT/JP2021/013191 mailed Apr. 27, 2021 (8 pages).
English translation of International Preliminary Report on Patentability issued in corresponding International Application No. PCT/JP2021/013191 dated Sep. 29, 2022 (6 pages).
Extended European Search Report issued in corresponding European Patent Application No. EP 21781291.6 dated Jul. 24, 2023 (10 pages).

* cited by examiner

AIR CONDITIONER

CROSS-REFERENCE TO RELATED APPLICATIONS

This is a continuation application of International Patent Application No. PCT/JP2021/013191, filed Mar. 29, 2021, and claims priority to Japanese Patent Application No. 2020-062742, filed on Mar. 31, 2020. The contents of these priority applications are incorporated herein by reference.

TECHNICAL FIELD

The present disclosure relates to an air conditioner.

BACKGROUND

Conventionally, there has been known an air conditioner in which an indoor unit and a plurality of outdoor units are connected by two connection pipes. As such an air conditioner, for example, PTL 1 (Japanese Unexamined Patent Application Publication No. 2016-70595) discloses that a high-pressure refrigerant or an intermediate-pressure refrigerant is used as a driving flow in an ejector, a gas refrigerant after an evaporation process of a refrigeration cycle is sucked and pressurized, and the pressurized refrigerant is supplied to a low-pressure-side connection pipe.

SUMMARY

An air conditioner according to a first aspect includes a heat-source-side unit, a plurality of use-side units, an intermediate unit, and two connection pipes. The heat-source-side unit has a compressor and a heat-source-side heat exchanger. The plurality of use-side units have a use-side heat exchanger. The intermediate unit switches each of a plurality of the use-side heat exchangers to individually function as an evaporator or a radiator of a refrigerant. The two connection pipes connect the heat-source-side unit and the intermediate unit. The intermediate unit has an ejector and a gas-liquid separator. The ejector pressurizes the refrigerant evaporated in the evaporator by using a driving flow. The refrigerant flowing out from the ejector flows into the gas-liquid separator. The ejector functions in a cooling-heating mixed operation mainly for cooling in which a sum of cooling operation loads of the plurality of use-side units is greater than a sum of heating operation loads of the plurality of use-side units.

DETAILED DESCRIPTION

An air conditioner according to one or more embodiments of the present disclosure will be described with reference to the drawings.

(1) General Configuration

Figure 1:
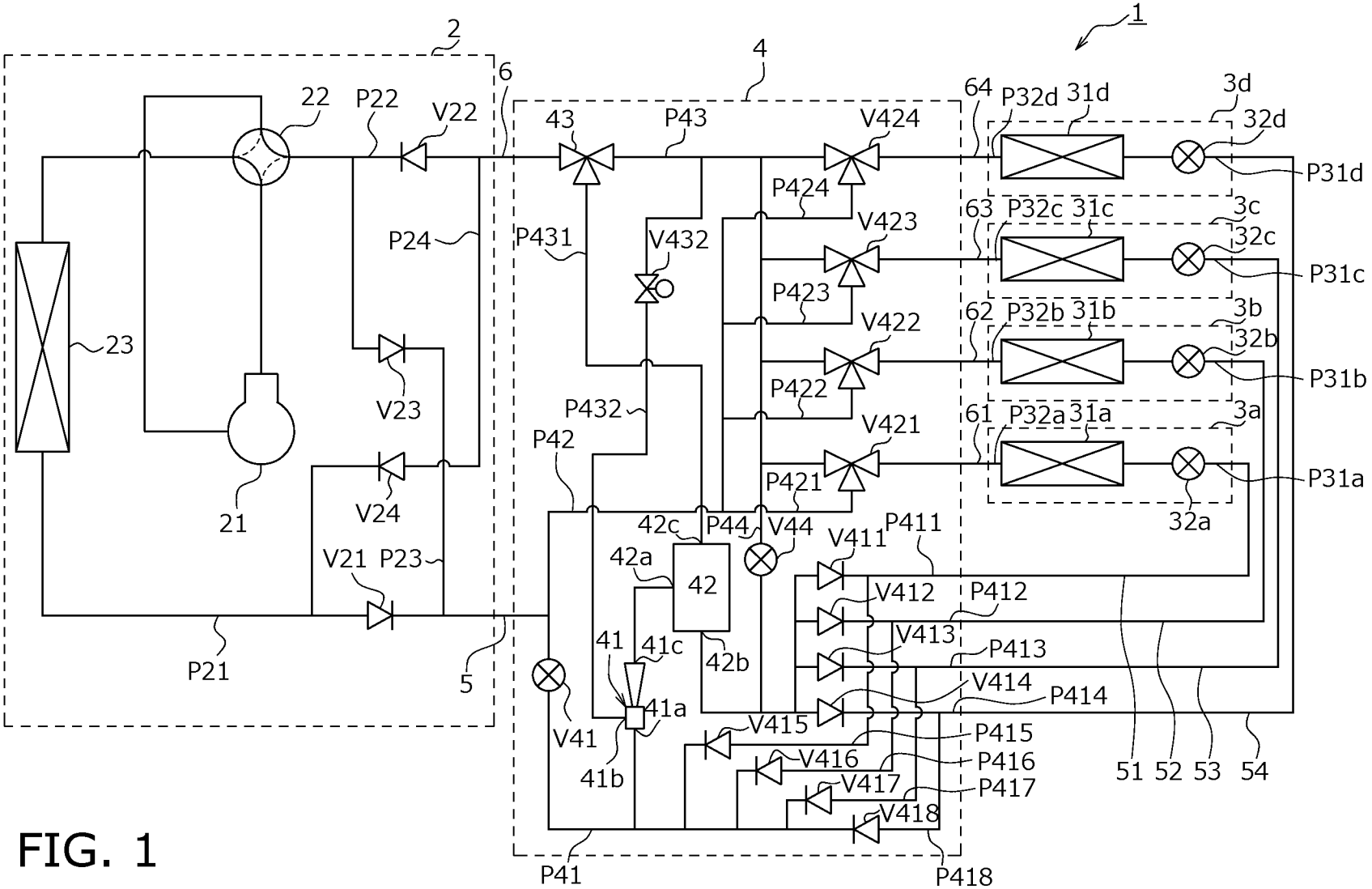
FIG. 1 is a schematic configuration diagram of an air conditioner according to one or more embodiments of the present disclosure.
Figure 2:
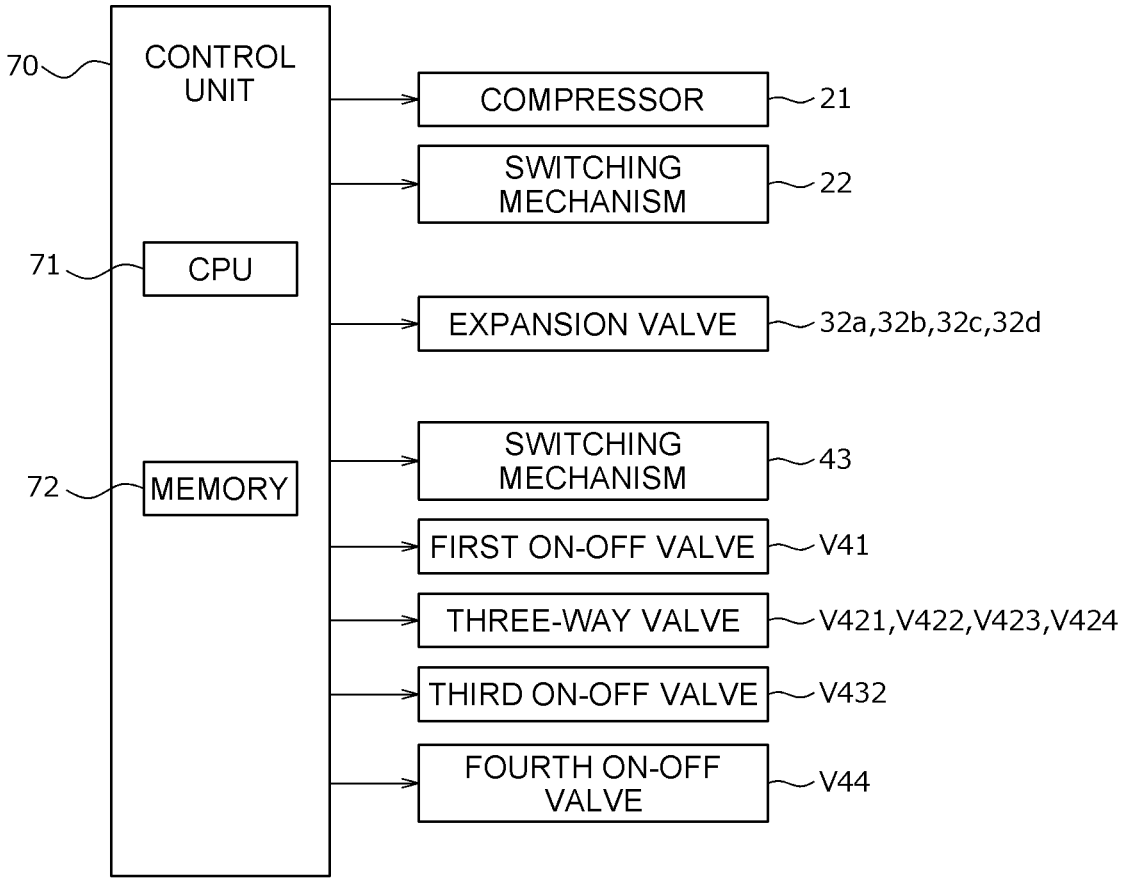
FIG. 2 is a block diagram schematically illustrating the air conditioner according to one or more embodiments of the present disclosure.

As illustrated in FIG. 1, an air conditioner 1 according to one or more embodiments of the present disclosure is an apparatus that performs cooling or heating in a room of a building or the like by a vapor compression refrigeration cycle. The air conditioner 1 includes a heat-source-side unit 2, a plurality of (four in this case) use-side units 3*a*, 3*b*, 3*c*, and 3*d*, an intermediate unit 4, connection pipes 5, 6, 51, 52, 53, 54, 61, 62, 63, and 64, and a control unit (i.e., controller) 70 illustrated in FIG. 2. A refrigerant circuit of the air conditioner 1 is configured by connecting the heat-source-side unit 2, the use-side units 3*a*, 3*b*, 3*c*, and 3*d*, the intermediate unit 4, and the connection pipes 5, 6, 51, 52, 53, 54, 61, 62, 63, and 64. The air conditioner 1 is configured so that each of the use-side units 3*a*, 3*b*, 3*c*, and 3*d* can individually perform a cooling operation or a heating operation by the intermediate unit 4.

The control unit 70 controls constituent devices of the heat-source-side unit 2, the use-side units 3*a*, 3*b*, 3*c*, and 3*d*, and the intermediate unit 4.

(2) Detailed Configuration (2-1) Connection Pipe

There are two connection pipes that connect the heat-source-side unit 2 and the intermediate unit 4. In this case, a first connection pipe 5 and a second connection pipe 6 connect the heat-source-side unit 2 and the intermediate unit 4. A refrigerant having a higher pressure than the pressure of the refrigerant in the second connection pipe 6 passes through the first connection pipe 5. The second connection pipe 6 is a low-pressure-side gas connection pipe.

Third connection pipes 51, 52, 53, and 54 and fourth connection pipes 61, 62, 63, and 64 connect the use-side units 3*a*, 3*b*, 3*c*, and 3*d* and the intermediate unit 4. In this case, since the four use-side units 3*a*, 3*b*, 3*c*, and 3*d* are disposed, four third connection pipes 51, 52, 53, and 54 and four fourth connection pipes 61, 62, 63, and 64 are disposed. Each of the third connection pipes 51, 52, 53, and 54 branches off from a pipe connected to the first connection pipe 5 in the intermediate unit 4. The fourth connection pipes 61, 62, 63, and 64 branch off from a pipe connected to the second connection pipe 6 in the intermediate unit.

As described above, the air conditioner 1 according to one or more embodiments is a two-pipe system having the two connection pipes that connect the heat-source-side unit 2 and the intermediate unit 4.

(2-2) Heat-Source-Side Unit

The heat-source-side unit 2 is installed on the rooftop of a building or the like or around the building or the like. The heat-source-side unit 2 is connected to the use-side units 3*a*, 3*b*, 3*c*, and 3*d* via the first connection pipe 5, the second connection pipe 6, the third connection pipes 51, 52, 53, and 54, the fourth connection pipes 61, 62, 63, and 64, and the intermediate unit 4, and constitutes a part of the refrigerant circuit.

The heat-source-side unit 2 mainly includes a compressor 21, a switching mechanism 22, and a heat-source-side heat exchanger 23.

The compressor 21 is a device in which the low-pressure refrigerant is compressed to become the high-pressure refrigerant. In this case, a compressor having a hermetically sealed structure in which a compression element (not illustrated) of positive-displacement type, such as rotary type or scroll type, is rotationally driven by a compressor motor is used as the compressor 21. The number of rotations of the compressor motor can be controlled by an inverter or the like, whereby the capacity of the compressor 21 can be controlled.

In one or more embodiments, the compressor 21 discharges the refrigerant in a supercritical state. Thus, the refrigerant in the supercritical state flows through a part of the refrigerant circuit. The refrigerant compressed in the compressor 21 contains carbon dioxide. In this case, carbon dioxide is used as the refrigerant.

The switching mechanism 22 is a four-way switching valve capable of switching the flow direction of the refrigerant in the refrigerant circuit. The switching mechanism 22 is an electric valve capable of switching between a heat-source-side heat radiation state in which the heat-source-side heat exchanger 23 is caused to function as a radiator of the refrigerant, and a heat-source-side evaporation state in which the heat-source-side heat exchanger 23 is caused to function as an evaporator of the refrigerant. The switching mechanism 22 is a device capable of switching the flow of the refrigerant in the refrigerant circuit so that the discharge side of the compressor 21 and the gas side of the heat-source-side heat exchanger 23 are connected when the heat-source-side heat exchanger is caused to function as the radiator of the refrigerant (see solid lines of the switching mechanism 22 in FIG. 1), and the suction side of the compressor 21 and the gas side of the heat-source-side heat exchanger 23 are connected when the heat-source-side heat exchanger 23 is caused to function as the evaporator of the refrigerant (see broken lines of the switching mechanism 22 in FIG. 1).

Note that the switching mechanism 22 is not limited to the mechanism configured by the four-way switching valve, and may be configured to be able to switch the flow direction of the refrigerant as described above, for example, by combining a plurality of electromagnetic valves and a plurality of refrigerant pipes.

The heat-source-side heat exchanger 23 performs heat exchange between the refrigerant and outdoor air. The heat-source-side heat exchanger 23 is a heat exchanger that functions as the radiator of the refrigerant or the evaporator of the refrigerant.

The heat-source-side unit 2 further has a heat-source-side first pipe P21, a heat-source-side second pipe P22, a heat-source-side third pipe P23, a heat-source-side fourth pipe P24, a heat-source-side first check valve V21, a heat-source-side second check valve V22, a heat-source-side third check valve V23, and a heat-source-side fourth check valve V24.

The refrigerant passes through the heat-source-side first and second pipes P21 and P22 in the heat-source-side heat radiation state in which the heat-source-side heat exchanger 23 is caused to function as the radiator of the refrigerant. The heat-source-side first pipe P21 connects the first connection pipe 5 and the heat-source-side heat exchanger 23. The heat-source-side second pipe P22 connects the second connection pipe 6 and the switching mechanism 22.

The refrigerant passes through the heat-source-side third and fourth pipes P23 and P24 in the heat-source-side evaporation state in which the heat-source-side heat exchanger 23 is caused to function as the evaporator of the refrigerant. The heat-source-side third pipe P23 connects the first connection pipe 5 and the switching mechanism 22. The heat-source-side fourth pipe P24 connects the second connection pipe 6 and the heat-source-side heat exchanger 23. In this case, the heat-source-side third and heat-source-side fourth pipes P23 and P24 branch off from the heat-source-side second pipe P22 and are connected to the heat-source-side first pipe P21.

The heat-source-side first check valve V21 is disposed in the heat-source-side first pipe P21. The heat-source-side first check valve V21 allows only the flow of the refrigerant from an outlet of the heat-source-side heat exchanger 23 to the first connection pipe 5. The heat-source-side second check valve V22 is disposed in the heat-source-side second pipe P22. The heat-source-side second check valve V22 allows only the flow of the refrigerant from the second connection pipe 6 to a suction port of the compressor 21. The heat-source-side third check valve V23 is disposed in the heat-source-side third pipe P23. The heat-source-side third check valve V23 allows only the flow of the refrigerant from a discharge port of the compressor 21 to the first connection pipe 5. The heat-source-side fourth check valve V24 is disposed in the heat-source-side fourth pipe P24. The heat-source-side fourth check valve V24 allows only the flow of the refrigerant from the second connection pipe 6 to the heat-source-side heat exchanger 23.

(2-3) Use-side Unit

The use-side units 3*a*, 3*b*, 3*c*, and 3*d* are installed, for example, by being embedded in or hung from a ceiling in a room of a building or the like, or by being hooked to a wall surface in the room. The use-side units 3*a*, 3*b*, 3*c*, and 3*d* are connected to the heat-source-side unit 2 via the first connection pipe 5, the second connection pipe 6, the third connection pipes 51, 52, 53, and 54, the fourth connection pipes 61, 62, 63, and 64, and the intermediate unit 4, and constitute a part of the refrigerant circuit.

Next, the configurations of the use-side units 3*a*, 3*b*, 3*c*, and 3*d* will be described. The use-side units 3*a*, 3*b*, 3*c*, and 3*d* include a first use-side unit 3*a*, a second use-side unit 3*b*, a third use-side unit 3*c*, and a fourth use-side unit 3*d* that are connected in parallel to one another.

The first use-side unit 3*a* has a first use-side heat exchanger 31*a* and a first use-side expansion valve 32*a*. The second use-side unit 3*b* has a second use-side heat exchanger 31*b* and a second use-side expansion valve 32*b*. The third use-side unit 3*c* has a third use-side heat exchanger 31*c* and a third use-side expansion valve 32*c*. The fourth use-side unit 3*d* has a fourth use-side heat exchanger 31*d* and a fourth use-side expansion valve 32*d*. Each of the use-side heat exchangers 31*a*, 31*b*, 31*c*, and 31*d* and a corresponding one of the use-side expansion valves 32*a*, 32*b*, 32*c*, and 32*d* are connected in series.

The use-side heat exchangers 31*a*, 31*b*, 31*c*, and 31*d* are heat exchangers that process indoor air-conditioning loads (heat loads) by performing heat exchange between the refrigerant and indoor air. The use-side heat exchangers 31*a*, 31*b*, 31*c*, and 31*d* function as evaporators of the refrigerant to cool the indoor air during a cooling operation, and function as radiators of the refrigerant to heat the indoor air during a heating operation.

The opening degrees of the use-side expansion valves 32*a*, 32*b*, 32*c*, and 32*d* are changeable. The degrees of depressurization of the use-side expansion valves 32*a*, 32*b*, 32*c*, and 32*d* are adjusted by adjusting the opening degrees of the use-side expansion valves 32*a*, 32*b*, 32*c*, and 32*d*. Specifically, the use-side expansion valves 32*a*, 32*b*, 32*c*, and 32*d* are electric expansion valves whose opening degrees can be adjusted to adjust the flow rates of the refrigerant flowing through the use-side heat exchangers 31*a*, 31*b*, 31*c*, and 31*d*.

Use-side first pipes P31*a*, P31*b*, P31*c*, and P31*d* connect the use-side heat exchangers 31*a*, 31*b*, 31*c*, and 31*d* and the third connection pipes 51, 52, 53, and 54. In the use-side first pipes P31*a*, P31*b*, P31*c*, and P31*d*, the use-side expansion valves 32*a*, 32*b*, 32*c*, and 32*d* are disposed between the third connection pipes 51, 52, 53, and 54 and the use-side heat exchangers 31*a*, 31*b*, 31*c*, and 31*d*. Use-side second pipes P32*a*, P32*b*, P32*c*, and P32*d* connect the use-side heat exchangers 31*a*, 31*b*, 31*c*, and 31*d* and the fourth connection pipes 61, 62, 63, and 64.

Although the air conditioner having the four use-side units is described here, the present disclosure can be also applied to a case where more or less use-side units are connected to one heat-source-side unit 2 to constitute one refrigerant circuit.

(2-4) Intermediate Unit

The intermediate unit 4 switches each of the plurality of use-side heat exchangers 31*a*, 31*b*, 31*c*, and 31*d* to individually function as the evaporator or the radiator of the refrigerant. The intermediate unit 4 is disposed together with the use-side units 3*a*, 3*b*, 3*c*, and 3*d* in a room of a building. The intermediate unit 4 is interposed between the use-side units 3*a*, 3*b*, 3*c*, and 3*d* and the heat-source-side unit 2 together with the connection pipes 5, 6, 51, 52, 53, 54, 61, 62, 63, and 64, and constitutes a part of the refrigerant circuit.

The intermediate unit 4 includes an ejector 41, a gas-liquid separator 42, and a switching mechanism 43.

The ejector 41 pressurizes the refrigerant evaporated in an evaporator by using a driving flow. Specifically, the ejector 41 is a pressurizing mechanism provided in the refrigerant circuit to suck and pressurize the refrigerant evaporated in the use-side heat exchangers 31*a*, 31*b*, 31*c*, and 31*d* that function as the evaporators of the refrigerant using the high-pressure refrigerant as the driving flow, and supply the pressurized refrigerant to the low-pressure-side second connection pipe 6.

The ejector 41 functions in a cooling-heating mixed operation mainly for cooling (cooling main operation). In this case, the ejector 41 may be configured not to function in the cooling main operation. Thus, it is possible to select whether to cause the ejector 41 to function or to cause the ejector 41 not to function during the cooling-heating mixed operation mainly for cooling.

The ejector 41 further functions in at least one of a cooling only operation and a cooling-heating equivalent operation. In this case, it is possible to select whether to cause the ejector 41 to function or cause the ejector 41 not to function during the cooling only operation and the cooling-heating equivalent operation.

Also, the ejector 41 is configured not to function in a heating only operation and a heating main operation.

The ejector 41 includes a driving flow inlet 41*a*, a suction flow inlet 41*b*, and a discharge port 41*c*. The driving flow flows into the driving flow inlet 41*a*. The driving flow inlet 41*a* communicates with the use-side heat exchanger 31*a* that functions as the evaporator of the refrigerant. The refrigerant evaporated in the evaporator flows into the suction flow inlet 41*b*. The refrigerant evaporated in the evaporator is pressurized and discharged from the discharge port 41*c*. The refrigerant discharged from the discharge port 41*c* is in a gas-liquid two-phase state.

The refrigerant flowing out from the ejector 41 flows into the gas-liquid separator 42. The gas-liquid separator 42 includes a refrigerant inlet 42*a*, a liquid-side outlet 42*b*, and a gas-side outlet 42*c*. The refrigerant inlet 42*a* communicates with the discharge port 41*c* of the ejector 41. The refrigerant in the gas-liquid two-phase state flows in from the refrigerant inlet 42*a*. The separated liquid refrigerant flows out from the liquid-side outlet 42*b*. The separated gas refrigerant flows out from the gas-side outlet 42*c*.

The switching mechanism 43 is a three-way valve. The switching mechanism 43 switches between a path of the refrigerant flowing from outlets of the evaporators to the second connection pipe 6 and a path of the refrigerant flowing from the gas-side outlet 42*c* of the gas-liquid separator 42 to the second connection pipe 6. In this case, the switching mechanism 43 can also switch so that the refrigerant flows from the liquid-side outlet 42*b* of the gas-liquid separator 42 to the second connection pipe 6.

The intermediate unit 4 further has an intermediate first pipe P41, an intermediate second pipe P42, an intermediate third pipe P43, first branch pipes P415, P416, P417, and P418, an intermediate first on-off valve V41, intermediate first check valves V411, V412, V413, V414, V415, V416, V417, and V418, three-way valves V421, V422, V423, and V424, a third connecting pipe P431, a third branch pipe P432, an intermediate third on-off valve V432, an intermediate fourth pipe P44, and an intermediate fourth on-off valve V44.

A pipe connected to the first connection pipe 5 in the intermediate unit 4 is branched into the intermediate first pipe P41 and the intermediate second pipe P42. A pipe connected to the second connection pipe 6 in the intermediate unit 4 is the intermediate third pipe P43.

The intermediate first pipe P41 connects the first connection pipe 5 and the connection pipes 51, 52, 53, and 54. The high-pressure refrigerant flows through the intermediate first pipe P41.

The intermediate first pipe P41 is provided with the ejector 41, the gas-liquid separator 42, and the intermediate first on-off valve V41. The intermediate first on-off valve V41 is disposed between the first connection pipe 5 and the ejector 41. In this case, the intermediate first on-off valve V41 is an electric valve.

The intermediate first pipe P41 is branched into four first connecting pipes P411, P412, P413, and P414 communicating with the third connection pipes 51, 52, 53, and 54, between the liquid-side outlet 42*b* of the gas-liquid separator 42 and the third connection pipes 51, 52, 53, and 54. The first connecting pipes P411, P412, P413, and P414 connect the third connection pipes 51, 52, 53, and 54 connected to the use-side heat exchangers 31*a*, 31*b*, 31*c*, and 31*d* and the gas-liquid separator 42.

The four first connecting pipes P411, P412, P413, and P414 are respectively provided with the intermediate first check valves V411, V412, V413, and V414 that allow only the flow of the refrigerant from the liquid-side outlet 42*b* of the gas-liquid separator 42 to inlets of the evaporators. The liquid-side outlet 42*b* of the gas-liquid separator 42 communicates with inlets of the intermediate first check valves V411, V412, V413, and V414.

The first branch pipes P415, P416, P417, and P418 respectively branch off from of the first connecting pipes P411, P412, P413, and P414 and guide the refrigerant to the driving flow inlet 41*a* of the ejector 41. The four first branch pipes P415, P416, P417, and P418 communicate the first connecting pipes P411, P412, P413, and P414 with the driving flow inlet 41*a* of the ejector 41.

The first branch pipe P415 branches off from the first connecting pipe P411 connected to the first use-side unit 3*a* via the third connection pipe 51. The first branch pipe P416 branches off from the first connecting pipe P412 connected to the second use-side unit 3*b* via the third connection pipe 52. The first branch pipe P417 branches off from the first connecting pipe P413 connected to the third use-side unit 3*c* via the third connection pipe 53. The first branch pipe P418 branches off from the first connecting pipe P414 connected to the fourth use-side unit 3*d* via the third connection pipe 54.

The first branch pipes P415, P416, P417, and P418 are provided with the intermediate second check valves V415, V416, V417, and V418 that allow only the flow of the refrigerant from outlets of the radiators to the driving flow inlet 41*a* of the ejector 41. The outlets of the radiators communicate with inlets of the intermediate second check valves V415, V416, V417, and V418.

The intermediate second pipe P42 connects the first connection pipe 5 and the connection pipes 61, 62, 63, and 64. The high-pressure refrigerant flows through the intermediate second pipe P42.

The intermediate second pipe P42 branches into four second connecting pipes P421, P422, P423, and P424 communicating with the fourth connection pipes 61, 62, 63, and 64. The four second connecting pipes P421, P422, P423, and P424 are respectively provided with the three-way valves V421, V422, V423, and V424. The three-way valves V421, V422, V423, and V424 switch between a path of the refrigerant flowing from the outlets of the evaporators to the intermediate unit 4 and a path of the refrigerant flowing from the intermediate unit 4 to the inlets of the radiators.

The intermediate third pipe P43 connects the second connection pipe 6 and the connection pipes 61, 62, 63, and 64. The low-pressure refrigerant flows through the intermediate third pipe P43. The intermediate third pipe P43 is provided with the switching mechanism 43 and the three-way valves V421, V422, V423, and V424.

The third connecting pipe P431 connects the switching mechanism 43 and the gas-side outlet 42*c* of the gas-liquid separator 42.

The third branch pipe P432 branches off from the intermediate third pipe P43 and guides the refrigerant to the suction flow inlet 41*b* of the ejector 41. The third branch pipe P432 connects the fourth connection pipes 61, 62, 63, and 64 and the suction flow inlet 41*b* of the ejector 41. The third branch pipe P432 allows the refrigerant evaporated in the evaporators to be sucked into the ejector 41.

The third branch pipe P432 is provided with the intermediate third on-off valve V432. In this case, the intermediate third on-off valve V432 is an electromagnetic valve.

The intermediate fourth pipe P44 connects a portion between the liquid-side outlet 42*b* of the gas-liquid separator 42 and the first connecting pipes P411, P412, P413, and P414 in the intermediate first pipe P41 and a portion between the three-way valves V421, V422, V423, and V424 and the switching mechanism 43 in the intermediate third pipe P43. The intermediate fourth pipe P44 communicates with the liquid-side outlet 42*b* of the gas-liquid separator 42, the three-way valves V421, V422, V423, and V424, and the switching mechanism 43.

The intermediate fourth pipe P44 is provided with the intermediate fourth on-off valve V44. In this case, the intermediate fourth on-off valve V44 is an electric valve.

(2-5) Control Unit

The control unit 70 controls constituent devices of the heat-source-side unit 2, the use-side units 3*a*, 3*b*, 3*c*, and 3*d*, and the intermediate unit 4.

The control unit 70 is implemented by, for example, a computer. The computer includes, for example, a control calculation device and a storage device. A processor can be used as the control calculation device. The control unit 70 of FIG. 2 includes a CPU 71 as a processor. For example, the control calculation device reads a program stored in the storage device, and performs predetermined image processing, calculation processing, or sequence processing in accordance with the program. Further, the control calculation device, for example, can write a calculation result in the storage device and read information stored in the storage device in accordance with the program. The storage device can be used as a database. The control unit 70 includes a memory 72 as the storage device.

The control unit 70 controls the compressor 21 and the switching mechanism 22 of the heat-source-side unit 2; the use-side expansion valves 32*a*, 32*b*, 32*c*, and 32*d* of the use-side units 3*a*, 3*b*, 3*c*, and 3*d*; and the switching mechanism 43, the intermediate first on-off valve V41, the three-way valves V421, V422, V423, and V424, the intermediate third on-off valve V432, and the intermediate fourth on-off valve V44 of the intermediate unit 4.

Specifically, the control unit 70 controls the intermediate first on-off valve V41 and the three-way valves V421, V422, V423, and V424 of the intermediate unit 4 so that each of the use-side units 3*a*, 3*b*, 3*c*, and 3*d* individually performs the cooling operation or the heating operation. Also, the control unit 70 controls the switching mechanism 43, the intermediate third on-off valve V432, and the intermediate fourth on-off valve V44 to perform an operation in which the ejector 41 is caused to function and an operation in which the ejector 41 is caused not to function. Also, in this case, the control unit 70 controls the degree of pressurization of the refrigerant that has radiated heat in the use-side units 3*a*, 3*b*, 3*c*, and 3*d* in the ejector 41 by the opening degree of the intermediate first on-off valve V41.

Also, the control unit 70 controls the ejector 41 not to function when the recovery amount of power is smaller than a predetermined amount, and controls the ejector 41 to function when the recovery amount of power is greater than the predetermined amount. For example, the control unit 70 provides control to perform an operation in which the ejector 41 is caused not to function when the temperature detected by a temperature sensor provided at the driving flow inlet 41*a* of the ejector 41 is lower than a predetermined temperature, and an operation in which the ejector 41 is caused to function when the temperature is equal to or higher than the predetermined temperature.

(3) Operation Actions

Operations of the air conditioner 1 according to one or more embodiments include a cooling only operation, a cooling main operation, a cooling-heating equivalent operation, a heating main operation, and a heating only operation. The cooling only operation is an operation in which all of the use-side units 3*a*, 3*b*, 3*c*, and 3*d* perform cooling. The cooling main operation is a cooling-heating mixed operation mainly for cooling in which the sum of the cooling operation loads of the plurality of use-side units 3*a*, 3*b*, 3*c*, and 3*d* is greater than the sum of the heating operation loads of the plurality of use-side units 3*a*, 3*b*, 3*c*, and 3*d*. The cooling-heating equivalent operation is a cooling-heating mixed operation in which the sum of the cooling operation loads and the sum of the heating operation loads of the plurality of use-side units 3*a*, 3*b*, 3*c*, and 3*d* are equivalent (i.e., the sum of the cooling operation loads is equal to the sum of the heating operation loads). The heating main operation is a cooling-heating mixed operation mainly for heating in which the sum of the heating operation loads of the plurality of use-side units 3*a*, 3*b*, 3*c*, and 3*d* is greater than the sum of the cooling operation loads of the plurality of use-side units 3*a*, 3*b*, 3*c*, and 3*d*. The heating only operation is an operation in which all of the use-side units 3*a*, 3*b*, 3*c*, and 3*d* perform heating. Referring to FIGS. 3 to 10, the actions of the air conditioner 1 in the five operations will be described below. In FIGS. 3 to 10, thick-line pipes indicate pipes through which the refrigerant flows, and thin-line pipes indicate pipes through which the refrigerant does not flow. A valve provided in a thick-line pipe is opened, and a valve provided in a thin-line pipe is closed.

In this case, in the cooling only operation, the cooling main operation, and the cooling-heating equivalent operation, the ejector 41 is configured to function and the ejector 41 is configured not to function. In contrast, in the heating main operation and the heating only operation, the ejector 41 is configured not to function.

(3-1) Cooling Only Operation (3-1-1) When Ejector Functions

Figure 3:
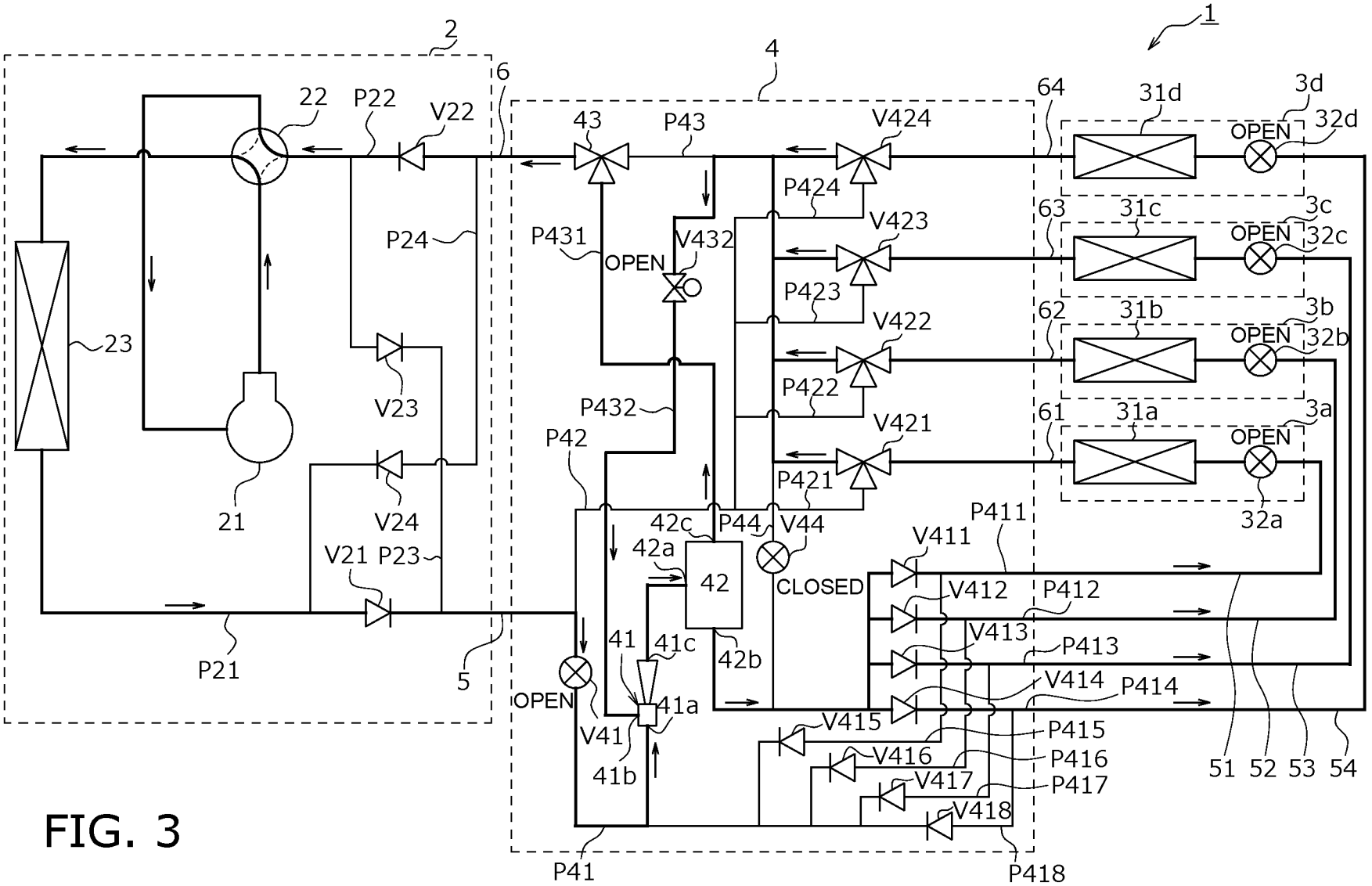
FIG. 3 is a schematic configuration diagram of the air conditioner according to one or more embodiments of the present disclosure (illustrating a flow of a refrigerant when an ejector functions during a cooling only operation).

As illustrated in FIG. 3, in the cooling only operation, for example, all of the use-side units 3*a*, 3*b*, 3*c*, and 3*d* perform a cooling operation (that is, an operation in which all of the use-side heat exchangers 31*a*, 31*b*, 31*c*, and 31*d* function as the evaporators of the refrigerant and the heat-source-side heat exchanger 23 functions as the radiator of the refrigerant).

At this time, in the heat-source-side unit 2, the control unit 70 switches the switching mechanism 22 to the heat-source-side heat radiation state (the state indicated by solid lines of the switching mechanism 22 in FIG. 3).

In the intermediate unit 4, the control unit 70 opens the intermediate first on-off valve V41 and the intermediate third on-off valve V432, and closes the intermediate fourth on-off valve V44. Also, the control unit 70 switches the three-way valves V421, V422, V423, and V424 so that the refrigerant flows from the outlets of the use-side heat exchangers 31*a*, 31*b*, 31*c*, and 31*d* that function as the evaporators of the refrigerant to the intermediate unit 4. Also, the control unit 70 switches the switching mechanism 43 so that the refrigerant flows from the gas-side outlet 42*c* of the gas-liquid separator 42 to the second connection pipe 6.

In the use-side units 3*a*, 3*b*, 3*c*, and 3*d*, the control unit 70 adjusts the opening degrees of the use-side expansion valves 32*a*, 32*b*, 32*c*, and 32*d* in accordance with the cooling loads of the respective use-side units 3*a*, 3*b*, 3*c*, and 3*d*.

When the control unit 70 controls the constituent devices of the heat-source-side unit 2, the use-side units 3*a*, 3*b*, 3*c*, and 3*d*, and the intermediate unit 4 in this way, the refrigerant in the supercritical state discharged from the compressor 21 is sent to the heat-source-side heat exchanger 23 via the switching mechanism 22 in the heat-source-side unit 2. The refrigerant sent to the heat-source-side heat exchanger 23 exchanges heat with the outdoor air and is cooled in the heat-source-side heat exchanger 23 that functions as the radiator of the refrigerant, thereby radiating heat. The refrigerant passes through the heat-source-side first pipe P21 and flows out from the heat-source-side unit 2 via the heat-source-side first check valve V21.

The refrigerant flowing out from the heat-source-side unit 2 is sent to the intermediate unit 4 through the first connection pipe 5. The refrigerant sent to the intermediate unit 4 passes through the intermediate first pipe P41 and flows into the driving flow inlet 41*a* of the ejector 41 via the intermediate first on-off valve V41. The refrigerant is mixed with the refrigerant flowing into the suction flow inlet 41*b* (the refrigerant evaporated in the use-side heat exchangers 31*a*, 31*b*, 31*c*, and 31*d* that function as the evaporators of the refrigerant), and is discharged from the discharge port 41*c*. The refrigerant in the gas-liquid two-phase state flowing out from the ejector 41 flows into the refrigerant inlet 42*a* of the gas-liquid separator 42. The refrigerant separated in the gas-liquid separator 42 and flowing out from the liquid-side outlet 42*b* is branched by the first connecting pipes P411, P412, P413, and P414, and flows out from the intermediate unit 4 via the intermediate first check valves V411, V412, V413, and V414.

The refrigerant flowing out from the intermediate unit 4 is sent to the use-side units 3*a*, 3*b*, 3*c*, and 3*d* through the third connection pipes 51, 52, 53, and 54. The refrigerant sent to the use-side units 3*a*, 3*b*, 3*c*, and 3*d* is sent to the use-side heat exchangers 31*a*, 31*b*, 31*c*, and 31*d* via the use-side expansion valves 32*a*, 32*b*, 32*c*, and 32*d*. The refrigerant sent to the use-side heat exchangers 31*a*, 31*b*, 31*c*, and 31*d* is heated by exchanging heat with the indoor air supplied from the inside of the room and is evaporated in the use-side heat exchangers 31*a*, 31*b*, 31*c*, and 31*d* that function as the evaporators of the refrigerant. The refrigerant flows out from the use-side units 3*a*, 3*b*, 3*c*, and 3*d*. In contrast, the indoor air cooled in the use-side heat exchangers 31*a*, 31*b*, 31*c*, and 31*d* is sent to the inside of the room, thereby cooling the inside of the room.

The refrigerant flowing out from the use-side units 3*a*, 3*b*, 3*c*, and 3*d* is sent to the intermediate unit 4 through the fourth connection pipes 61, 62, 63, and 64. The refrigerant sent to the intermediate unit 4 flows through the intermediate second pipe P42, passes through the intermediate fourth pipe P44 via the three-way valves V421, V422, V423, and V424, and merges at the intermediate third pipe P43. The merged refrigerant flows into the third branch pipe P432, and flows into the suction flow inlet 41*b* of the ejector 41 via the intermediate third on-off valve V432. In the ejector 41, the refrigerant is mixed with the refrigerant as the driving flow flowing in from the driving flow inlet 41*a* described above, and is pressurized. The pressurized and discharged refrigerant in the two-phase state flows into the refrigerant inlet 42*a* of the gas-liquid separator 42. Then, the refrigerant separated in the gas-liquid separator 42 and flowing out from the gas-side outlet 42*c* flows through the third connecting pipe P431 and flows into the intermediate third pipe P43 by the switching mechanism 43. The refrigerant flowing into the intermediate third pipe P43 via the switching mechanism 43 flows out from the intermediate unit 4.

The refrigerant flowing out from the intermediate unit 4 is sent to the heat-source-side unit 2 through the second connection pipe 6. The refrigerant sent to the heat-source-side unit 2 passes through the heat-source-side second pipe P22 and is sucked into the compressor 21 via the heat-source-side second check valve V22 and the switching mechanism 22.

In this way, during the cooling only operation described above, the ejector 41 is caused to function to pressurize the refrigerant evaporated in the use-side heat exchangers 31*a*, 31*b*, 31*c*, and 31*d* that function as the evaporators of the refrigerant. Then, the refrigerant is returned to the compressor 21 through the second connection pipe 6.

(3-1-2) When Ejector Does Not Function

Figure 4:
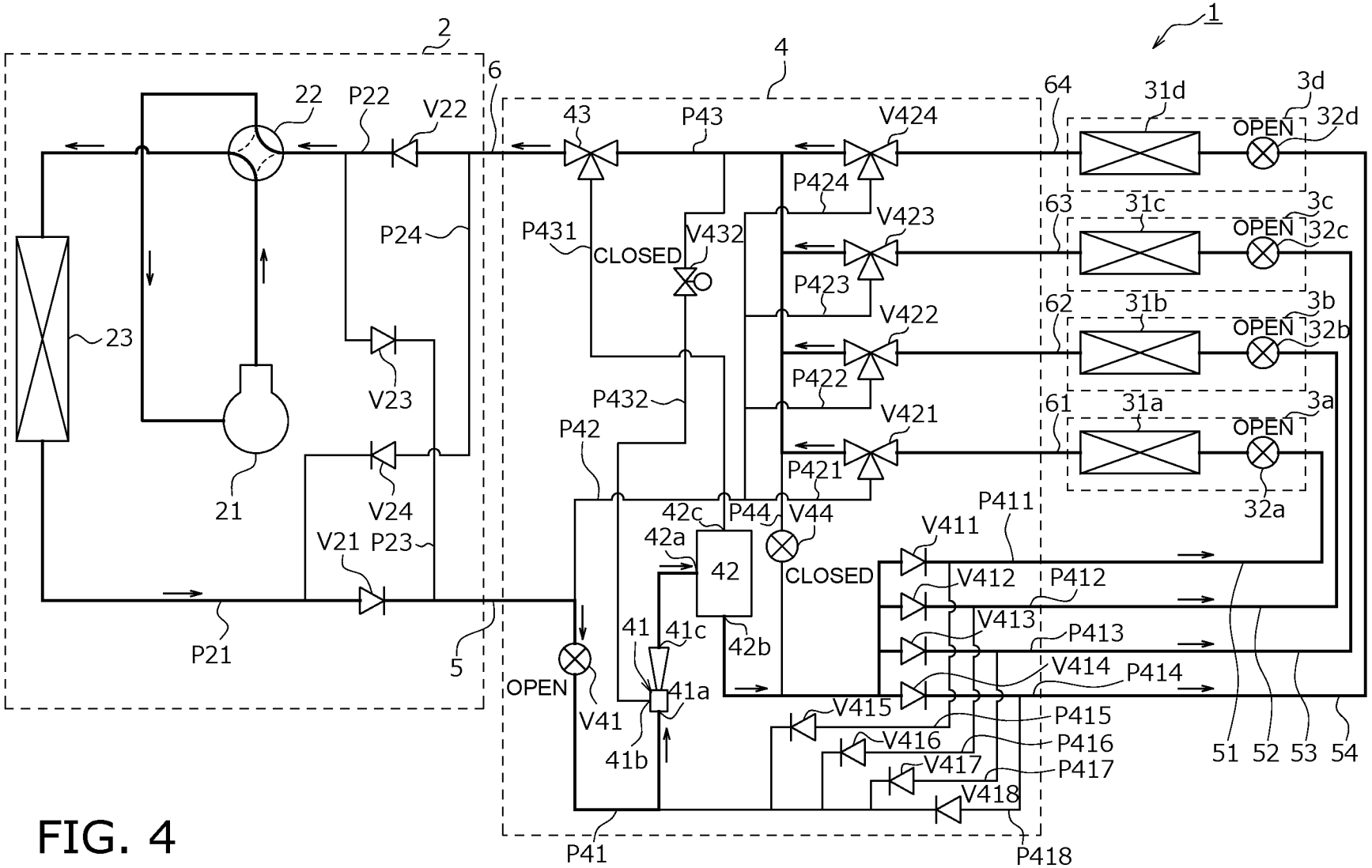
FIG. 4 is a schematic configuration diagram of the air conditioner according to one or more embodiments of the present disclosure (illustrating a flow of the refrigerant when the ejector does not function during the cooling only operation).

To cause the ejector 41 not to function in the intermediate unit 4, as illustrated in FIG. 4, the control unit 70 opens the intermediate first on-off valve V41 and closes the intermediate third on-off valve V432 and the intermediate fourth on-off valve V44. Also, the control unit 70 switches the three-way valves V421, V422, V423, and V424 so that the refrigerant flows from the outlets of the evaporators to the intermediate unit 4. Also, the control unit 70 switches the switching mechanism 43 so that the refrigerant flows from the outlets of the evaporators to the second connection pipe 6.

In this case, the high-pressure refrigerant sent from the heat-source-side unit 2 to the intermediate unit 4 through the first connection pipe 5 passes through the intermediate first pipe P41, and flows into the driving flow inlet 41*a* of the ejector 41 via the intermediate first on-off valve V41. The refrigerant is discharged from the discharge port 41*c* of the ejector 41 and flows into the refrigerant inlet 42*a* of the gas-liquid separator 42. The refrigerant separated in the gas-liquid separator 42 and flowing out from the liquid-side outlet 42*b* is branched by the first connecting pipes P411, P412, P413, and P414, and flows out from the intermediate unit 4 via the intermediate first check valves V411, V412, V413, and V414.

The refrigerant flowing out from the intermediate unit 4 is sent to the use-side units 3*a*, 3*b*, 3*c*, and 3*d* through the third connection pipes 51, 52, 53, and 54. The refrigerant sent to the use-side units 3*a*, 3*b*, 3*c*, and 3*d* is sent via the use-side expansion valves 32*a*, 32*b*, 32*c*, and 32*d* to the use-side heat exchangers 31*a*, 31*b*, 31*c*, and 31*d* that function as the evaporators of the refrigerant. The refrigerant after heat exchange in the use-side heat exchangers 31*a*, 31*b*, 31*c*, and 31*d* flows out from the use-side units 3*a*, 3*b*, 3*c*, and 3*d*.

The refrigerant flowing out from the use-side units 3*a*, 3*b*, 3*c*, and 3*d* is sent to the intermediate unit 4 through the fourth connection pipes 61, 62, 63, and 64. The refrigerant sent to the intermediate unit 4 flows through the intermediate second pipe P42, passes through the three-way valves V421, V422, V423, and V424, and merges at the intermediate third pipe P43. Since the intermediate third on-off valve V432 is closed, the merged refrigerant flows toward the switching mechanism 43 without flowing through the third branch pipe P432 (without flowing toward the suction flow inlet 41*b* of the ejector 41). The refrigerant passing through the switching mechanism 43 flows out from the intermediate unit 4.

The refrigerant flowing out from the intermediate unit 4 is sent to the heat-source-side unit 2 through the second connection pipe 6. The refrigerant sent to the heat-source-side unit 2 is sucked into the compressor 21 via the heat-source-side second check valve V22 and the switching mechanism 22.

In this way, during the cooling only operation described above, the refrigerant evaporated in the use-side heat exchangers 31*a*, 31*b*, 31*c*, and 31*d* that function as the evaporators of the refrigerant is returned to the compressor 21 through the second connection pipe 6 without being pressurized in the ejector 41.

(3-2) Cooling Main Operation (3-2-1) When Ejector Functions

Figure 5:
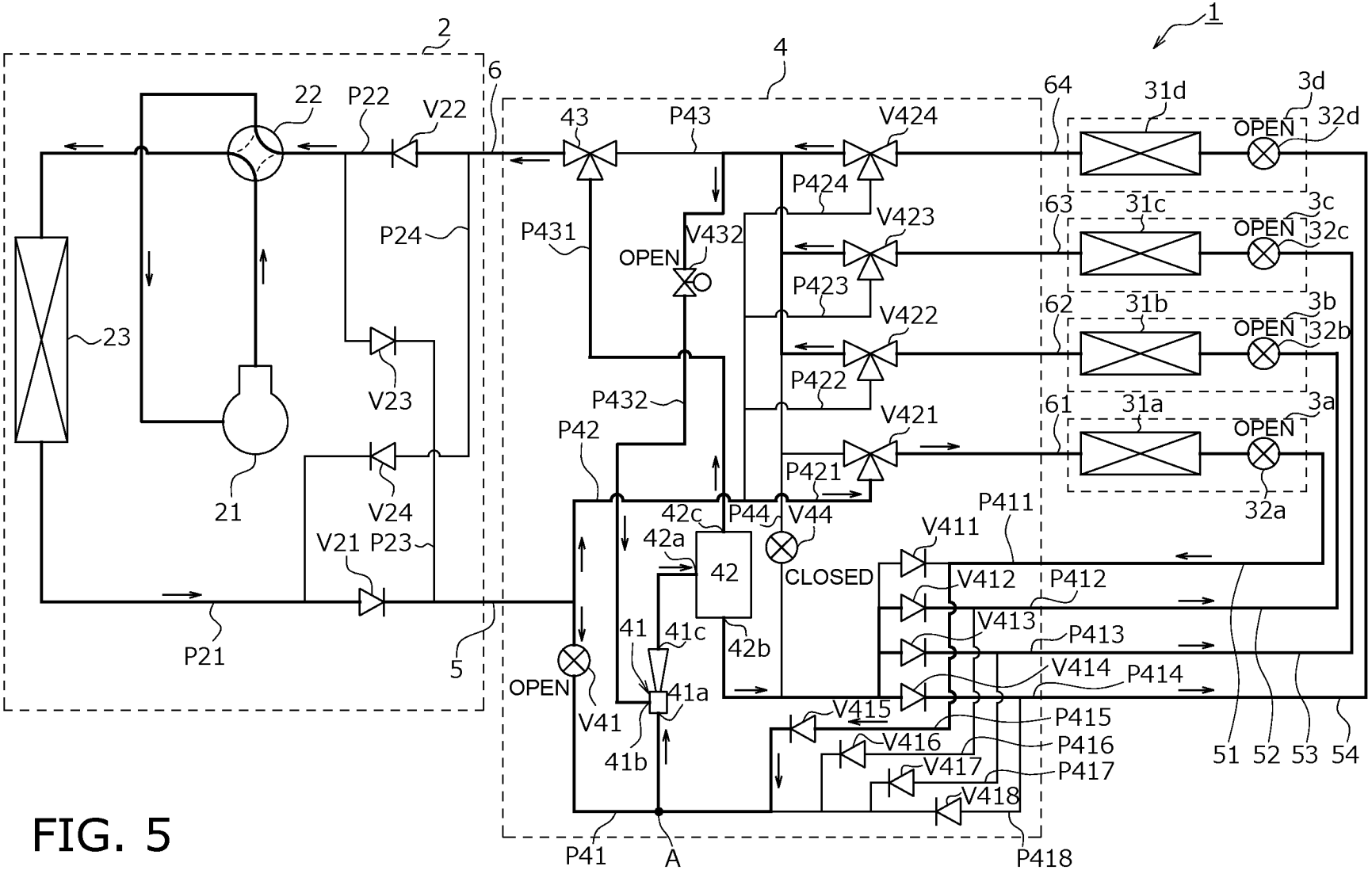
FIG. 5 is a schematic configuration diagram of the air conditioner according to one or more embodiments of the present disclosure (illustrating a flow of the refrigerant when the ejector functions during a cooling main operation).

As illustrated in FIG. 5, during the cooling main operation, for example, the use-side units 3*b*, 3*c*, and 3*d* perform the cooling operation, and the use-side unit 3*a* performs the heating operation (that is, an operation in which the use-side heat exchangers 31*b*, 31*c*, and 31*d* function as the evaporators of the refrigerant, and the use-side heat exchanger 31*a* functions as the radiator of the refrigerant).

At this time, in the heat-source-side unit 2, the control unit 70 switches the switching mechanism 22 to the heat-source-side heat radiation state (the state indicated by solid lines of the switching mechanism 22 in FIG. 3).

In the intermediate unit 4, the control unit 70 opens the intermediate first on-off valve V41 and the intermediate third on-off valve V432, and closes the intermediate fourth on-off valve V44. Also, the control unit 70 switches the three-way valves V422, V423, and V424 so that the refrigerant flows from the outlets of the use-side heat exchangers 31*b*, 31*c*, and 31*d* that function as the evaporators of the refrigerant to the intermediate unit 4. In contrast, the control unit 70 switches the three-way valve V421 so that the refrigerant flows from the intermediate unit 4 to the inlet of the use-side heat exchanger 31*a* that functions as the radiator of the refrigerant. Also, the control unit 70 switches the switching mechanism 43 so that the refrigerant flows from the gas-side outlet 42*c* of the gas-liquid separator 42 to the second connection pipe 6.

In the use-side units 3*a*, 3*b*, 3*c*, and 3*d*, the control unit 70 adjusts the opening degrees of the use-side expansion valves 32*a*, 32*b*, 32*c*, and 32*d* in accordance with the heating load of the use-side unit 3*a* and the cooling loads of the use-side units 3*b*, 3*c*, and 3*d*.

When the control unit 70 controls the constituent devices of the heat-source-side unit 2, the use-side units 3*a*, 3*b*, 3*c*, and 3*d*, and the intermediate unit 4 in this way, the refrigerant in the supercritical state discharged from the compressor 21 passes through the heat-source-side heat exchanger 23 and flows out from the heat-source-side unit 2 to the first connection pipe 5, as in the cooling only operation.

A portion of the refrigerant sent to the intermediate unit 4 through the first connection pipe 5 flows through the intermediate first pipe P41, and the rest of the refrigerant flows through the intermediate second pipe P42. The refrigerant flowing through the intermediate second pipe P42 flows out from the intermediate unit 4 via the three-way valve V421. The refrigerant flows into the use-side unit 3*a* through the fourth connection pipe 61.

The high-pressure refrigerant sent to the use-side unit 3*a* exchanges heat with the indoor air supplied from the inside of the room and is cooled in the use-side heat exchanger 31*a* that functions as the radiator of the refrigerant, thereby radiating heat. The refrigerant flows out from the use-side unit 3*a* via the use-side expansion valve 32*a*. In contrast, the indoor air heated in the use-side heat exchanger 31*a* is sent to the inside of the room, thereby heating the inside of the room.

The refrigerant flowing out from the use-side unit 3*a* passes through the third connection pipe 51 and flows into the first connecting pipe P411 of the intermediate unit 4. The refrigerant flows from the first connecting pipe P411, flows through the first branch pipe P415, passes through the intermediate second check valve V415, and merges at a point A with the refrigerant flowing through the intermediate first pipe P41 via the intermediate first on-off valve V41.

The merged refrigerant flows into the driving flow inlet 41*a* of the ejector 41. The refrigerant is mixed with the refrigerant, which is evaporated in the use-side heat exchangers 31*b*, 31*c*, and 31*d* that function as the evaporators of the refrigerant and flows into the suction flow inlet 41*b*, and is discharged from the discharge port 41*c*. The refrigerant in the gas-liquid two-phase state flowing out from the ejector 41 flows into the refrigerant inlet 42*a* of the gas-liquid separator 42. The refrigerant separated in the gas-liquid separator 42 and flowing out from the liquid-side outlet 42*b* is branched by the first connecting pipes P412, P413, and P414, and flows out from the intermediate unit 4 via the intermediate first check valves V412, V413, and V414.

The refrigerant flowing out from the intermediate unit 4 is sent to the use-side units 3*b*, 3*c*, and 3*d* through the third connection pipes 52, 53, and 54. The refrigerant sent to the use-side units 3*b*, 3*c*, and 3*d* is sent to the use-side heat exchangers 31*b*, 31*c*, and 31*d* via the use-side expansion valves 32*b*, 32*c*, and 32*d*. The refrigerant sent to the use-side heat exchangers 31*b*, 31*c*, and 31*d* is heated by exchanging heat with the indoor air supplied from the inside of the room and is evaporated in the use-side heat exchangers 31*b*, 31*c*, and 31*d* that function as the evaporators of the refrigerant. The refrigerant flows out from the use-side units 3*b*, 3*c*, and 3*d*. In contrast, the indoor air cooled in the use-side heat exchangers 31*b*, 31*c*, and 31*d* is sent to the inside of the room, thereby cooling the inside of the room.

The refrigerant flowing out from the use-side units 3*b*, 3*c*, and 3*d* is sent to the intermediate unit 4 through the fourth connection pipes 62, 63, and 64. The refrigerant sent to the intermediate unit 4 passes through the three-way valves V422, V423, and V424 and merges in the intermediate third pipe P43. The merged refrigerant flows into the third branch pipe P432, and flows into the suction flow inlet 41*b* of the ejector 41 via the intermediate third on-off valve V432. The low-pressure refrigerant flowing into the suction flow inlet 41*b* of the ejector 41 is mixed with the refrigerant as the driving flow flowing in from the driving flow inlet 41*a* described above, and is pressurized in the ejector 41. The pressurized and discharged refrigerant in the two-phase state flows into the refrigerant inlet 42*a* of the gas-liquid separator 42. The refrigerant separated in the gas-liquid separator 42 and flowing out from the gas-side outlet 42*c* flows through the third connecting pipe P431, flows into the intermediate third pipe P43 by the switching mechanism 43, and flows out from the intermediate unit 4.

The refrigerant flowing out from the intermediate unit 4 is sent to the heat-source-side unit 2 through the second connection pipe 6. The refrigerant sent to the heat-source-side unit 2 is sucked into the compressor 21 via the heat-source-side second check valve V22 and the switching mechanism 22.

In this way, during the cooling main operation described above, the ejector 41 is caused to function to pressurize the refrigerant evaporated in the use-side heat exchangers 31*b*, 31*c*, and 31*d* that function as the evaporators of the refrigerant, and then return the refrigerant to the compressor 21.

(3-2-2) When Ejector Does Not Function

Figure 6:
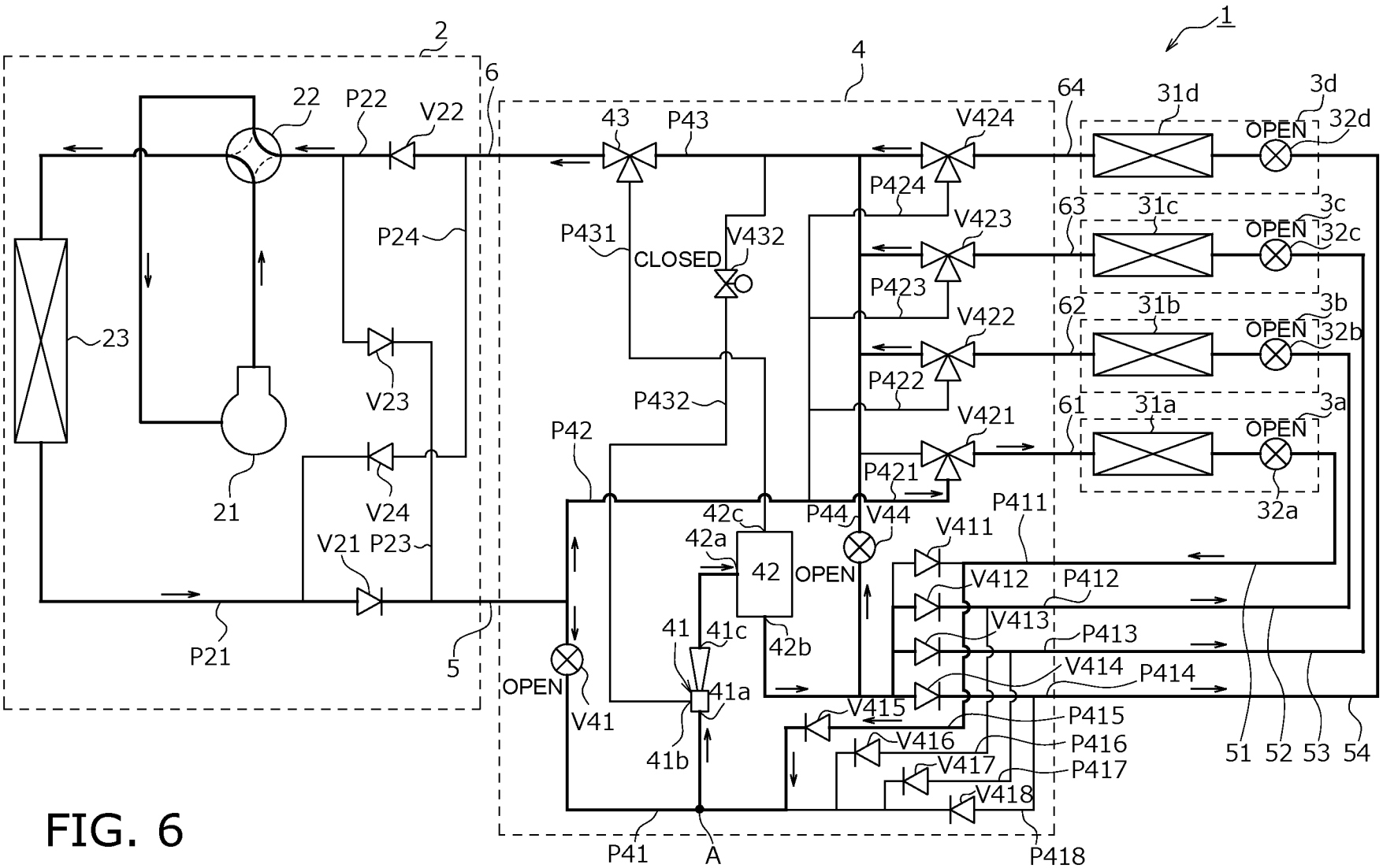
FIG. 6 is a schematic configuration diagram of the air conditioner according to one or more embodiments of the present disclosure (illustrating a flow of the refrigerant when the ejector does not function during the cooling main operation).

To cause the ejector 41 not to function in the intermediate unit 4, as illustrated in FIG. 6, the control unit 70 opens the intermediate first on-off valve V41 and the intermediate fourth on-off valve V44 and closes the intermediate third on-off valve V432. Also, the control unit 70 switches the three-way valves V422, V423, and V424 so that the refrigerant flows from the outlets of the evaporators to the intermediate unit 4. In contrast, the control unit 70 switches the three-way valve V421 so that the refrigerant flows from the intermediate unit 4 to the inlet of the radiator. Also, the control unit 70 switches the switching mechanism 43 so that the refrigerant flows from the outlets of the evaporators to the second connection pipe 6.

In this case, a portion of the refrigerant sent from the heat-source-side unit 2 to the intermediate unit 4 through the first connection pipe 5 flows through the intermediate first pipe P41, and the rest of the refrigerant flows through the intermediate second pipe P42. The refrigerant flowing through the intermediate second pipe P42 flows out from the intermediate unit 4 via the three-way valve V421, passes through the fourth connection pipe 61, and flows into the use-side unit 3*a*.

The high-pressure refrigerant sent to the use-side unit 3*a* exchanges heat in the use-side heat exchanger 31*a* that functions as the radiator of the refrigerant, and then flows out from the use-side unit 3*a*. The refrigerant flowing out from the use-side unit 3*a* passes through the third connection pipe 51, flows into the first connecting pipe P411 of the intermediate unit 4, and flows through the first branch pipe P415. The refrigerant flowing through the intermediate second check valve V415 merges at the point A with the refrigerant flowing through the intermediate first pipe P41 via the intermediate first on-off valve V41.

The merged refrigerant flows into the driving flow inlet 41*a* of the ejector 41, is discharged from the discharge port 41*c*, and flows into the refrigerant inlet 42*a* of the gas-liquid separator 42. A portion of the refrigerant flowing out from the liquid-side outlet 42*b* of the gas-liquid separator 42 flows into the intermediate fourth pipe P44, and the rest of the refrigerant is branched by the first connecting pipes P412, P413, and P414 and flows out from the intermediate unit 4.

The refrigerant flowing out from the intermediate unit 4 is sent to the use-side units 3*b*, 3*c*, and 3*d* through the third connection pipes 52, 53, and 54. The refrigerant sent to the use-side units 3*b*, 3*c*, and 3*d* exchanges heat in the use-side heat exchangers 31*b*, 31*c*, and 31*d* that function as the evaporators of the refrigerant, and then flows out from the use-side units 3*b*, 3*c*, and 3*d*.

The refrigerant flowing out from the use-side units 3*b*, 3*c*, and 3*d* is sent to the intermediate unit 4 through the fourth connection pipes 62, 63, and 64. In the intermediate unit 4, the refrigerant passing through each of the three-way valves V422, V423, and V424 and the refrigerant flowing through the intermediate fourth pipe P44 are merged. Since the intermediate third on-off valve V432 is closed, the merged refrigerant flows toward the switching mechanism 43 without flowing toward the suction flow inlet 41*b* of the ejector 41. The refrigerant flows out from the intermediate unit 4 via the switching mechanism 43.

The refrigerant flowing out from the intermediate unit 4 is sent to the heat-source-side unit 2 through the second connection pipe 6. The refrigerant sent to the heat-source-side unit 2 is sucked into the compressor 21 via the heat-source-side second check valve V22 and the switching mechanism 22.

In this way, during the cooling main operation described above, the refrigerant evaporated in the use-side heat exchangers 31*b*, 31*c*, and 31*d* that function as the evaporators of the refrigerant is returned to the compressor 21 through the second connection pipe 6 without being pressurized in the ejector 41.

(3-3) Cooling-heating Equivalent Operation (3-3-1) When Ejector Functions

Figure 7:
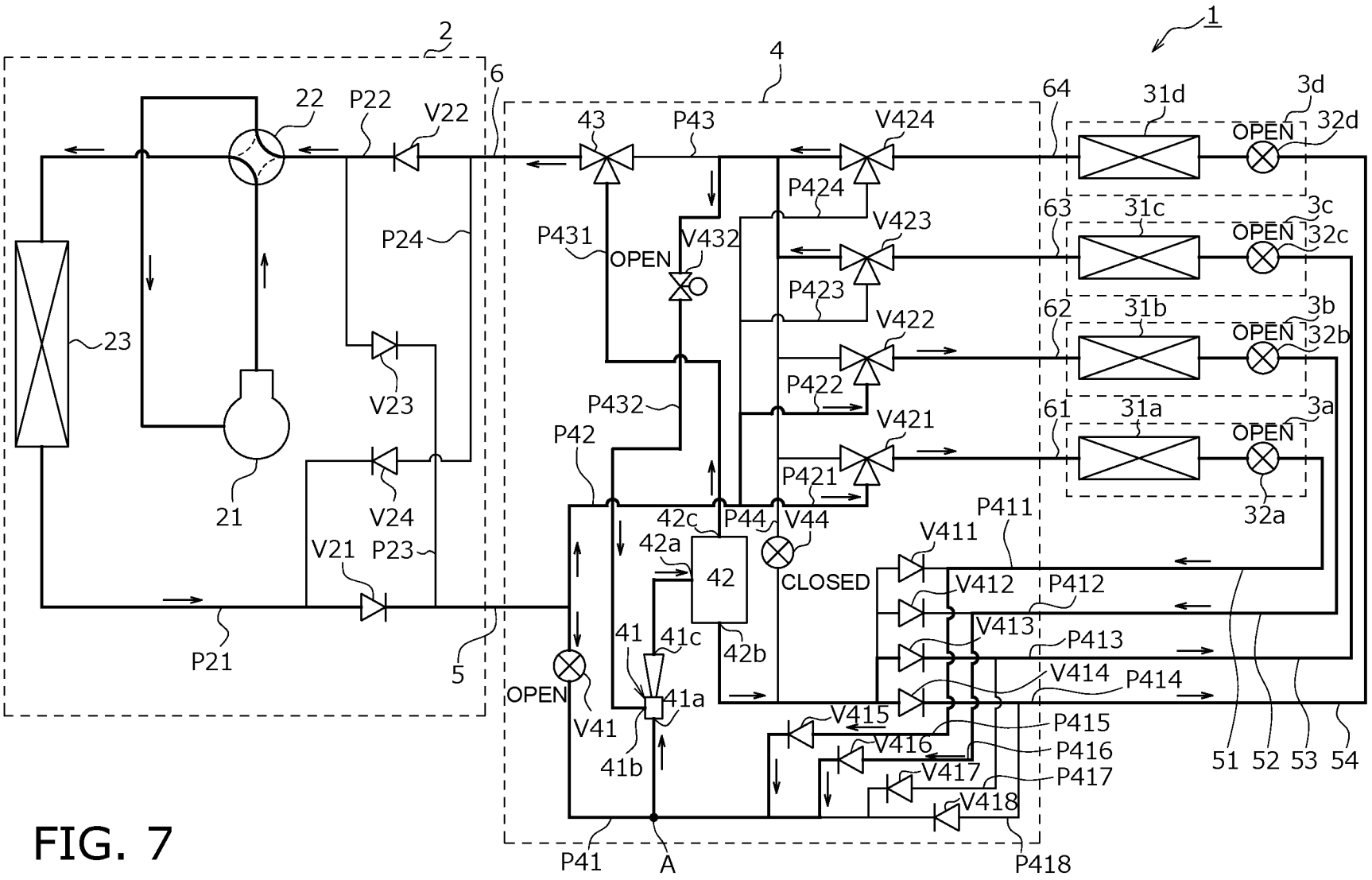
FIG. 7 is a schematic configuration diagram of the air conditioner according to one or more embodiments of the present disclosure (illustrating a flow of the refrigerant when the ejector functions during a cooling-heating equivalent operation).

As illustrated in FIG. 7, in the cooling-heating equivalent operation, for example, the use-side units 3*c* and 3*d* perform the cooling operation, and the use-side units 3*a* and 3*b* perform the heating operation (that is, an operation in which the use-side heat exchangers 31*c* and 31*d* function as the evaporators of the refrigerant, and the use-side heat exchangers 31*a* and 31*b* function as the radiators of the refrigerant).

At this time, in the heat-source-side unit 2, the control unit 70 switches the switching mechanism 22 to the heat-source-side heat radiation state (the state indicated by solid lines of the switching mechanism 22 in FIG. 7).

In the intermediate unit 4, the control unit 70 opens the intermediate first on-off valve V41 and the intermediate third on-off valve V432, and closes the intermediate fourth on-off valve V44. Also, the control unit 70 switches the three-way valves V423 and V424 so that the refrigerant flows from the outlets of the evaporators to the intermediate unit 4. In contrast, the control unit 70 switches the three-way valves V421 and V422 so that the refrigerant flows from the intermediate unit 4 to the inlets of the radiators. Also, the control unit 70 switches the switching mechanism 43 so that the refrigerant flows from the gas-side outlet 42*c* of the gas-liquid separator 42 to the second connection pipe 6.

In the use-side units 3*a*, 3*b*, 3*c*, and 3*d*, the control unit 70 adjusts the opening degrees of the use-side expansion valves 32*a*, 32*b*, 32*c*, and 32*d* in accordance with the heating loads of the use-side units 3*a* and 3*b* and the cooling loads of the use-side units 3*c*, and 3*d*.

When the control unit 70 controls the constituent devices of the heat-source-side unit 2, the use-side units 3*a*, 3*b*, 3*c*, and 3*d*, and the intermediate unit 4 in this way, the refrigerant in the supercritical state discharged from the compressor 21 passes through the heat-source-side heat exchanger 23 and flows out from the heat-source-side unit 2 to the first connection pipe 5, as in the cooling only operation.

A portion of the refrigerant sent to the intermediate unit 4 through the first connection pipe 5 flows through the intermediate first pipe P41, and the rest of the refrigerant flows through the intermediate second pipe P42. The refrigerant flowing through the intermediate second pipe P42 flows out from the intermediate unit 4 via the three-way valves V421 and V422. The refrigerant flows into the use-side units 3*a* and 3*b* through the fourth connection pipes 61 and 62.

The high-pressure refrigerant sent to the use-side units 3*a* and 3*b* exchanges heat with the indoor air supplied from the inside of the room and is cooled in the use-side heat exchangers 31*a* and 31*b* that function as the radiators of the refrigerant, thereby radiating heat. The refrigerant flows out from the use-side units 3*a* and 3*b* via the use-side expansion valves 32*a* and 32*b*. In contrast, the indoor air heated in the use-side heat exchangers 31*a* and 31*b* is sent to the inside of the room, thereby heating the inside of the room.

The refrigerant flowing out from the use-side units 3*a* and 3*b* passes through the third connection pipes 51 and 52 and flows into the first connecting pipes P411 and P412 of the intermediate unit 4. The refrigerant flows from the first connecting pipes P411 and P412, flows through the first branch pipes P415 and P416, passes through the intermediate second check valves V415 and V416, and merges at the point A with the refrigerant flowing through the intermediate first pipe P41 via the intermediate first on-off valve V41.

The merged refrigerant flows into the driving flow inlet 41*a* of the ejector 41. The refrigerant is mixed with the refrigerant, which is evaporated in the use-side heat exchangers 31*c* and 31*d* that function as the evaporators of the refrigerant and flows into the suction flow inlet 41*b*, and is discharged from the discharge port 41*c*. The refrigerant in the gas-liquid two-phase state flowing out from the ejector 41 flows into the refrigerant inlet 42*a* of the gas-liquid separator 42. The refrigerant separated in the gas-liquid separator 42 and flowing out from the liquid-side outlet 42*b* is branched by the first connecting pipes P413 and P414, and flows out from the intermediate unit 4 via the intermediate first check valves V413 and V414.

The refrigerant flowing out from the intermediate unit 4 is sent to the use-side units 3*c* and 3*d* through the third connection pipes 53 and 54. The refrigerant sent to the use-side units 3*c* and 3*d* is sent to the use-side heat exchangers 31*c* and 31*d* via the use-side expansion valves 32*c* and 32*d*. The refrigerant sent to the use-side heat exchangers 31*c* and 31*d* is heated by exchanging heat with the indoor air supplied from the inside of the room and is evaporated in the use-side heat exchangers 31*c* and 31*d* that function as the evaporators of the refrigerant. The refrigerant flows out from the use-side units 3*c* and 3*d*. In contrast, the indoor air cooled in the use-side heat exchangers 31*c* and 31*d* is sent to the inside of the room, thereby cooling the inside of the room.

The refrigerant flowing out from the use-side units 3*c* and 3*d* is sent to the intermediate unit 4 through the fourth connection pipes 63 and 64. The refrigerant sent to the intermediate unit 4 passes through the three-way valves V423 and V424 and merges in the intermediate third pipe P43. The merged refrigerant flows into the third branch pipe P432, and flows into the suction flow inlet 41*b* of the ejector 41 via the intermediate third on-off valve V432. The low-pressure refrigerant flowing into the suction flow inlet 41*b* of the ejector 41 is mixed with the refrigerant as the driving flow flowing in from the driving flow inlet 41*a* described above, and is pressurized in the ejector 41. The pressurized and discharged refrigerant in the two-phase state flows into the refrigerant inlet 42*a* of the gas-liquid separator 42. The refrigerant separated in the gas-liquid separator 42 and flowing out from the gas-side outlet 42*c* flows through the third connecting pipe P431, flows into the intermediate third pipe P43 by the switching mechanism 43, and flows out from the intermediate unit 4.

The refrigerant flowing out from the intermediate unit 4 is sent to the heat-source-side unit 2 through the second connection pipe 6. The refrigerant sent to the heat-source-side unit 2 is sucked into the compressor 21 via the heat-source-side second check valve V22 and the switching mechanism 22.

In this way, during the cooling-heating equivalent operation described above, the ejector 41 is caused to function to pressurize the refrigerant evaporated in the use-side heat exchangers 31*c* and 31*d* that function as the evaporators of the refrigerant, and then return the refrigerant to the compressor 21.

(3-3-2) When Ejector Does Not Function

Figure 8:
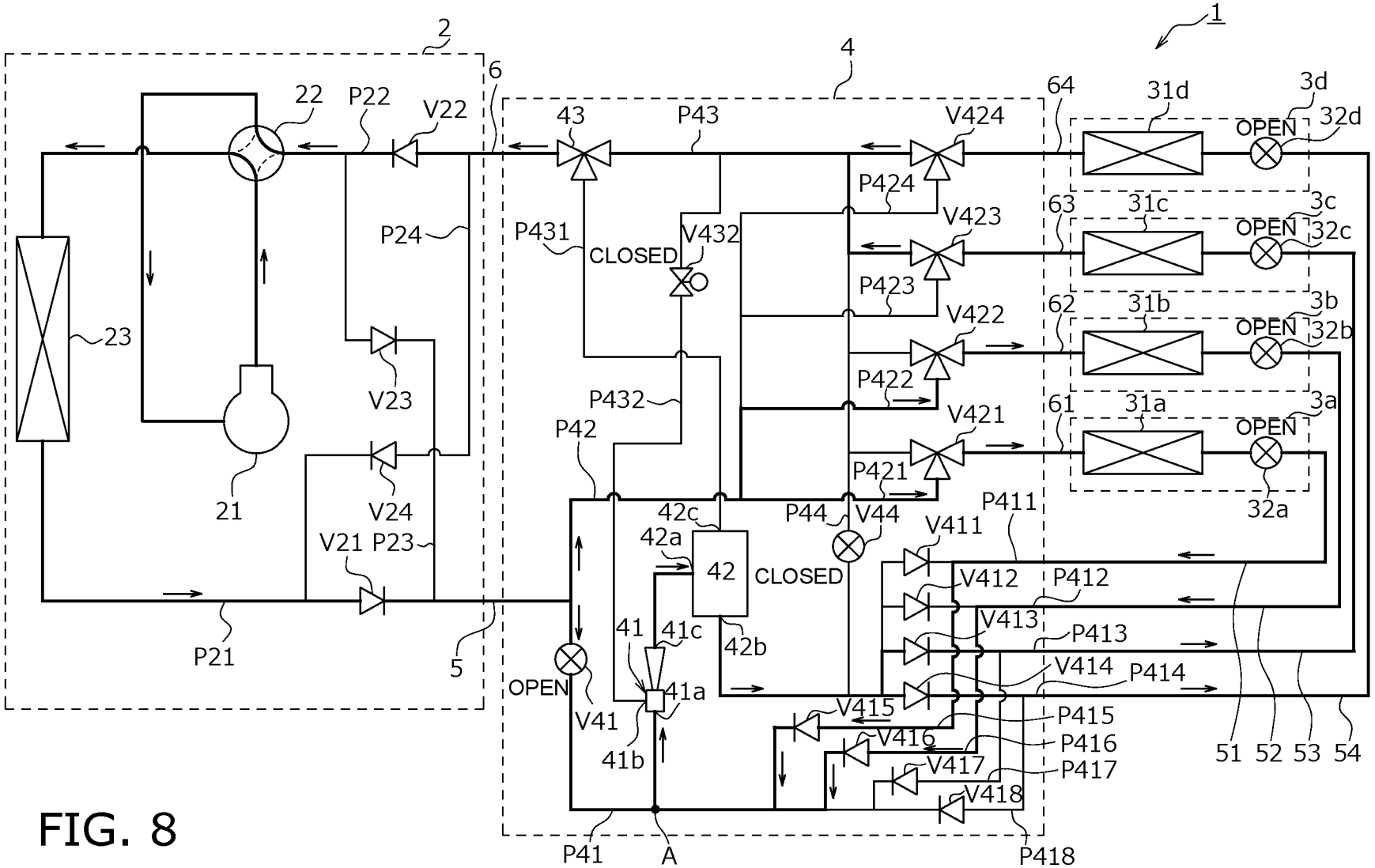
FIG. 8 is a schematic configuration diagram of the air conditioner according to one or more embodiments of the present disclosure (illustrating a flow of the refrigerant when the ejector does not function during the cooling-heating equivalent operation).

To cause the ejector 41 not to function in the intermediate unit 4, as illustrated in FIG. 8, the control unit 70 opens the intermediate first on-off valve V41 and closes the intermediate third on-off valve V432 and the intermediate fourth on-off valve V44. Also, the control unit 70 switches the three-way valves V423 and V424 so that the refrigerant flows from the outlets of the evaporators to the intermediate unit 4. In contrast, the control unit 70 switches the three-way valves V421 and V422 so that the refrigerant flows from the intermediate unit 4 to the inlets of the radiators. Also, the control unit 70 switches the switching mechanism 43 so that the refrigerant flows from the outlets of the evaporators to the second connection pipe 6.

In this case, a portion of the refrigerant sent from the heat-source-side unit 2 to the intermediate unit 4 through the first connection pipe 5 flows through the intermediate first pipe P41, and the rest of the refrigerant flows through the intermediate second pipe P42. The refrigerant flowing through the intermediate second pipe P42 flows out from the intermediate unit 4 via the three-way valves V421 and V422, passes through the fourth connection pipes 61 and 62, and flows into the use-side units 3*a* and 3*b*.

The high-pressure refrigerant sent to the use-side units 3*a* and 3*b* exchanges heat in the use-side heat exchangers 31*a* and 31*b* that function as the radiators of the refrigerant, and then flows out from the use-side units 3*a* and 3*b*. The refrigerant flowing out from the use-side units 3*a* and 3*b* passes through the third connection pipes 51 and 52, flows into the first connecting pipes P411 and P412 of the intermediate unit 4, and flows through the first branch pipes P415 and P416. Then, at the point A, the refrigerant passes through the intermediate first on-off valve V41 and merges with the refrigerant flowing through the intermediate first pipe P41.

The merged refrigerant flows into the driving flow inlet 41*a* of the ejector 41, is discharged from the discharge port 41*c*, and flows into the refrigerant inlet 42*a* of the gas-liquid separator 42. The refrigerant flowing out from the liquid-side outlet 42*b* of the gas-liquid separator 42 is branched by the first connecting pipes P413 and P414 and flows out from the intermediate unit 4.

The refrigerant flowing out from the intermediate unit 4 is sent to the use-side units 3*c* and 3*d* through the third connection pipes 53 and 54. The refrigerant sent to the use-side units 3*c* and 3*d* exchanges heat in the use-side heat exchangers 31*c* and 31*d* that function as the evaporators of the refrigerant, and then flows out from the use-side units 3*c* and 3*d*.

The refrigerant flowing out from the use-side units 3*c* and 3*d* is sent to the intermediate unit 4 through the fourth connection pipes 63 and 64. The refrigerant sent to the intermediate unit 4 passes through the three-way valves V423 and V424 and merges in the intermediate third pipe P43. Since the intermediate third on-off valve V432 is closed, the merged refrigerant flows toward the switching mechanism 43 without flowing through the suction flow inlet 41*b* of the ejector 41. The refrigerant flows out from the intermediate unit 4 via the switching mechanism 43.

The refrigerant flowing out from the intermediate unit 4 is sent to the heat-source-side unit 2 through the second connection pipe 6. The refrigerant sent to the heat-source-side unit 2 is sucked into the compressor 21 via the heat-source-side second check valve V22 and the switching mechanism 22.

In this way, during the cooling-heating equivalent operation described above, the refrigerant evaporated in the use-side heat exchangers 31*c* and 31*d* that function as the evaporators of the refrigerant is returned to the compressor 21 through the second connection pipe 6 without being pressurized in the ejector 41.

(3-4) Heating Main Operation

Figure 9:
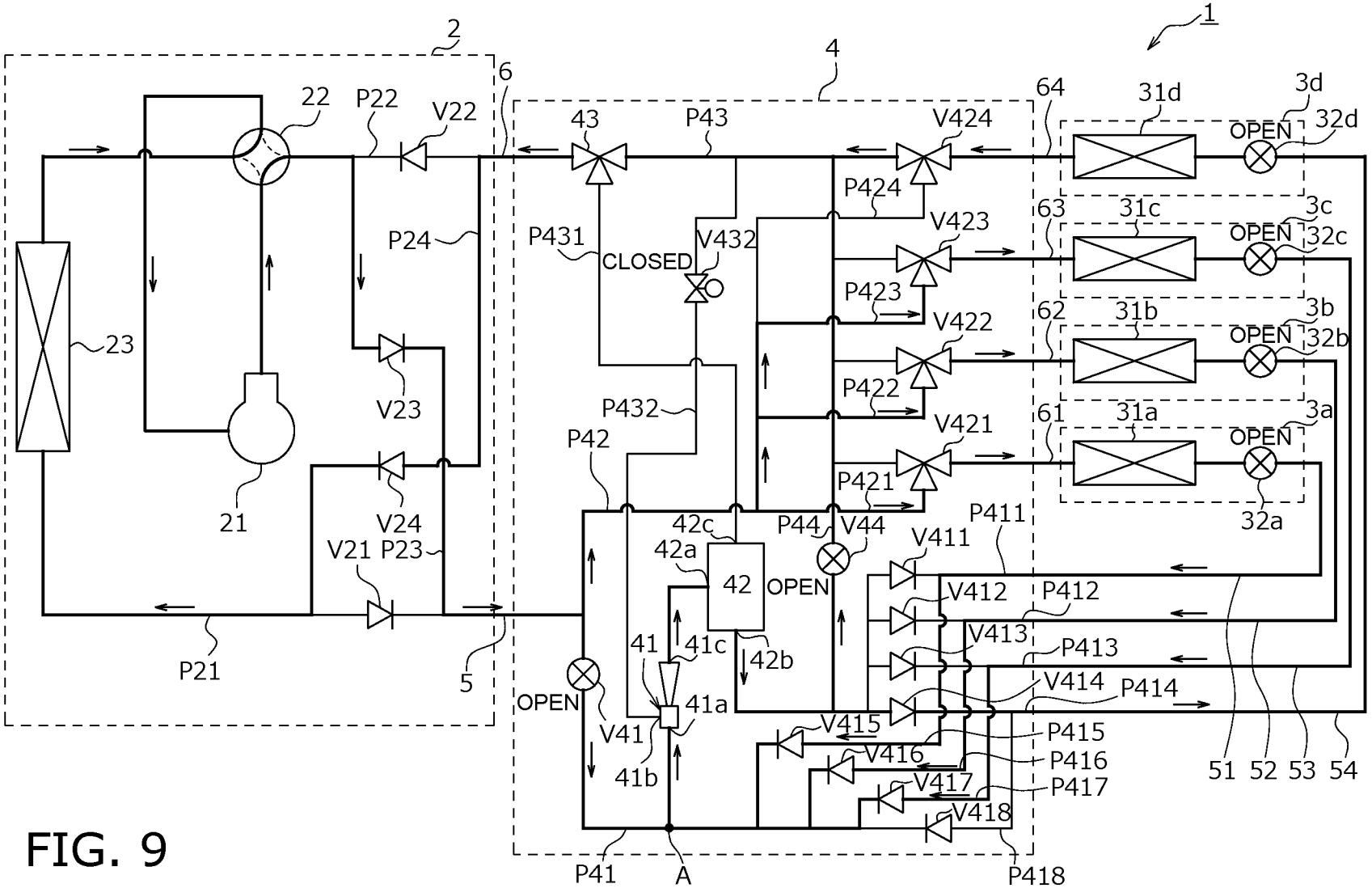
FIG. 9 is a schematic configuration diagram of the air conditioner according to one or more embodiments of the present disclosure (illustrating a flow of the refrigerant during a heating main operation).

As illustrated in FIG. 9, in the heating main operation, for example, the use-side unit 3*d* performs the cooling operation, and the use-side units 3*a*, 3*b*, and 3*c* perform the heating operation (that is, an operation in which the use-side heat exchanger 31*d* functions as the evaporator of the refrigerant, and the use-side heat exchangers 31*a*, 31*b*, and 31*c* function as the radiators of the refrigerant).

At this time, in the heat-source-side unit 2, the control unit 70 switches the switching mechanism 22 to the heat-source-side evaporation state (the state indicated by solid lines of the switching mechanism 22 in FIG. 9).

In the intermediate unit 4, the control unit 70 opens the intermediate first on-off valve V41 and the intermediate fourth on-off valve V44, and closes the intermediate third on-off valve V432. Also, the control unit 70 switches the three-way valve V424 so that the refrigerant flows from the outlet of the evaporator to the intermediate unit 4. In contrast, the control unit 70 switches the three-way valves V421, V422, and V423 so that the refrigerant flows from the intermediate unit 4 to the inlets of the radiators. Also, the control unit 70 switches the switching mechanism 43 so that the refrigerant flows from the outlet of the evaporator to the second connection pipe 6. Also in this case, the control unit 70 switches the switching mechanism 43 so that the refrigerant flows from the liquid-side outlet 42*b* of the gas-liquid separator 42 to the second connection pipe 6.

In the use-side units 3*a*, 3*b*, 3*c*, and 3*d*, the control unit 70 adjusts the opening degrees of the use-side expansion valves 32*a*, 32*b*, and 32*c* in accordance with the heating loads of the use-side units 3*a*, 3*b*, and 3*c* and the cooling load of the use-side unit 3*d*.

When the control unit 70 controls the constituent devices of the heat-source-side unit 2, the use-side units 3*a*, 3*b*, 3*c*, and 3*d*, and the intermediate unit 4 in this way, the refrigerant in the supercritical state discharged from the compressor 21 passes through the switching mechanism 22, flows into the heat-source-side third pipe P23, and flows out from the heat-source-side unit 2 to the first connection pipe 5 via the heat-source-side third check valve V23.

A portion of the refrigerant sent to the intermediate unit 4 through the first connection pipe 5 flows through the intermediate first pipe P41, and the rest of the refrigerant flows through the intermediate second pipe P42. The refrigerant flowing through the intermediate second pipe P42 flows out from the intermediate unit 4 via the three-way valves V421, V422, and V423. The refrigerant flows into the use-side units 3*a*, 3*b*, and 3*c* through the fourth connection pipes 61, 62, and 63.

The high-pressure refrigerant sent to the use-side units 3*a*, 3*b*, and 3*c* exchanges heat with the indoor air supplied from the inside of the room and is cooled in the use-side heat exchangers 31*a*, 31*b*, and 31*c* that function as the radiators of the refrigerant, thereby radiating heat. The refrigerant flows out from the use-side units 3*a*, 3*b*, and 3*c* via the use-side expansion valves 32*a*, 32*b*, and 32*c*. In contrast, the indoor air heated in the use-side heat exchangers 31*a*, 31*b*, and 31*c* is sent to the inside of the room, thereby heating the inside of the room.

The refrigerant flowing out from the use-side units 3*a*, 3*b*, and 3*c* passes through the third connection pipes 51, 52, and 53 and flows into the first connecting pipes P411, P412, and P413 of the intermediate unit 4. The refrigerant flows from the first connecting pipes P411, P412, and P413, flows through the first branch pipes P415, P416, and P417, passes through the intermediate second check valves V415, V416, and V417, and merges at the point A with the refrigerant flowing through the intermediate first pipe P41 via the intermediate first on-off valve V41.

The merged refrigerant flows into the driving flow inlet 41*a* of the ejector 41, is discharged from the discharge port 41*c*, and flows into the refrigerant inlet 42*a* of the gas-liquid separator 42. A portion of the refrigerant flowing out from the liquid-side outlet 42*b* of the gas-liquid separator 42 flows into the intermediate fourth pipe P44, and the rest of the refrigerant flows into the first connecting pipe P414. The refrigerant flowing through the first connecting pipes P414 flows out from the intermediate unit 4 via the intermediate first check valve V414.

The refrigerant flowing out from the intermediate unit 4 is sent to the use-side unit 3*d* through the third connection pipe 54. The refrigerant sent to the use-side unit 3*d* is sent to the use-side heat exchanger 31*d* via the use-side expansion valve 32*d*. The refrigerant sent to the use-side heat exchanger 31*d* is heated by exchanging heat with the indoor air supplied from the inside of the room and is evaporated in the use-side heat exchanger 31*d* that functions as the evaporator of the refrigerant. The refrigerant flows out from the use-side unit 3*d*. In contrast, the indoor air cooled in the use-side heat exchanger 31*d* is sent to the inside of the room, thereby cooling the inside of the room.

The refrigerant flowing out from the use-side unit 3*d* is sent to the intermediate unit 4 through the fourth connection pipe 64. The refrigerant sent to the intermediate unit 4 passes through the three-way valve V424 and merges with the refrigerant flowing through the intermediate fourth pipe P44 in the intermediate third pipe P43. Since the intermediate third on-off valve V432 is closed, the merged refrigerant flows toward the switching mechanism 43 without flowing through the suction flow inlet 41*b* of the ejector 41. The refrigerant flows out from the intermediate unit 4 via the switching mechanism 43.

The refrigerant flowing out from the intermediate unit 4 is sent to the heat-source-side unit 2 through the second connection pipe 6. The refrigerant sent to the heat-source-side unit 2 flows into the heat-source-side fourth pipe P24, passes through the heat-source-side fourth check valve V24, further flows into the heat-source-side first pipe P21, and is sent to the heat-source-side heat exchanger 23. The refrigerant sent to the heat-source-side heat exchanger 23 is heated by exchanging heat with the outdoor air and is evaporated in the heat-source-side heat exchanger 23 that functions as the evaporator of the refrigerant. The evaporated refrigerant is sucked into the compressor 21 via the switching mechanism 22.

In this way, during the heating main operation described above, the refrigerant is returned to the compressor 21 through the second connection pipe 6 without being pressurized in the ejector 41.

(3-5) Heating Only Operation

Figure 10:
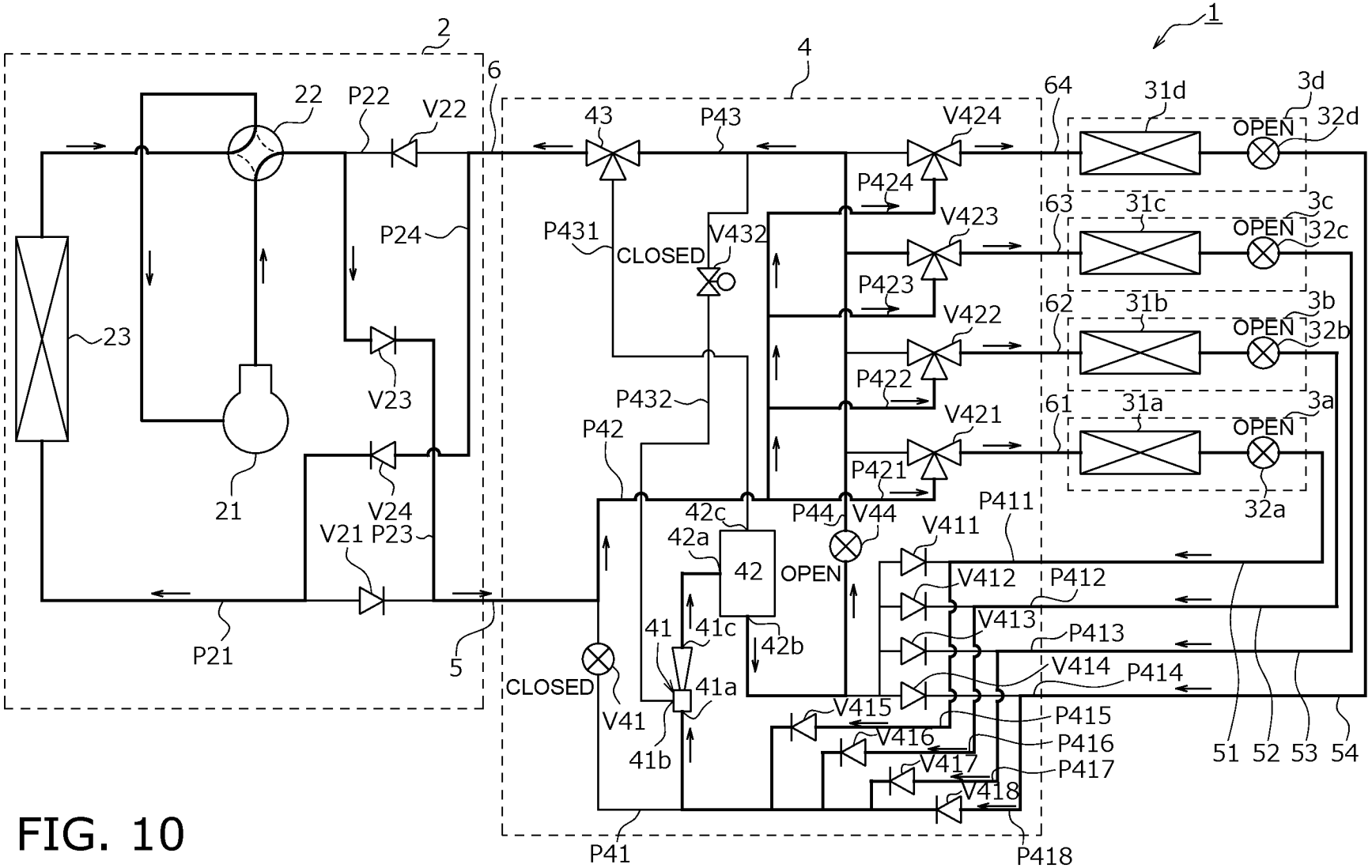
FIG. 10 is a schematic configuration diagram of the air conditioner according to one or more embodiments of the present disclosure (illustrating a flow of the refrigerant during a heating only operation).

As illustrated in FIG. 10, in the heating only operation, for example, all of the use-side units 3*a*, 3*b*, 3*c*, and 3*d* perform the heating operation (that is, an operation in which all of the use-side heat exchangers 31*a*, 31*b*, 31*c*, and 31*d* function as the radiators of the refrigerant and the heat-source-side heat exchanger 23 functions as evaporator of the refrigerant).

At this time, in the heat-source-side unit 2, the control unit 70 switches the switching mechanism 22 to the heat-source-side evaporation state (the state indicated by solid lines of the switching mechanism 22 in FIG. 10).

In the intermediate unit 4, the control unit 70 opens the intermediate fourth on-off valve V44, and closes the intermediate first on-off valve V41 and the intermediate third on-off valve V432. Also, the control unit 70 switches the three-way valves V421, V422, V423, and V424 so that the refrigerant flows from the intermediate unit 4 to the inlets of the radiators. Also, the control unit 70 switches the switching mechanism 43 so that the refrigerant flows from the liquid-side outlet 42*b* of the gas-liquid separator 42 to the second connection pipe 6.

In the use-side units 3*a*, 3*b*, 3*c*, and 3*d*, the control unit 70 adjusts the opening degrees of the use-side expansion valves 32*a*, 32*b*, 32*c*, and 32*d* in accordance with the heating loads of the use-side units 3*a*, 3*b*, 3*c*, and 3*d*.

When the control unit 70 controls the constituent devices of the heat-source-side unit 2, the use-side units 3*a*, 3*b*, 3*c*, and 3*d*, and the intermediate unit 4 in this way, the refrigerant in the supercritical state discharged from the compressor 21 passes through the switching mechanism 22, and flows out from the heat-source-side unit 2 to the first connection pipe 5 via the heat-source-side third check valve V23.

The refrigerant sent to the intermediate unit 4 through the first connection pipe 5 flows through the intermediate second pipe P42 and flows out from the intermediate unit 4 via the three-way valves V421, V422, V423, and V424. The refrigerant flows into the use-side units 3*a*, 3*b*, 3*c*, and 3*d* through the fourth connection pipes 61, 62, 63, and 64.

The high-pressure refrigerant sent to the use-side units 3*a*, 3*b*, 3*c*, and 3*d* exchanges heat with the indoor air supplied from the inside of the room and is cooled in the use-side heat exchangers 31*a*, 31*b*, 31*c*, and 31*d* that function as the radiators of the refrigerant, thereby radiating heat. The refrigerant flows out from the use-side units 3*a*, 3*b*, 3*c*, and 3*d* via the use-side expansion valves 32*a*, 32*b*, and 32*c*. In contrast, the indoor air heated in the use-side heat exchangers 31*a*, 31*b*, 31*c*, and 31*d* is sent to the inside of the room, thereby heating the inside of the room.

The refrigerant flowing out from the use-side units 3*a*, 3*b*, 3*c*, and 3*d* passes through the third connection pipes 51, 52, 53, and 54 and flows into the first connecting pipes P411, P412, P413, and P414 of the intermediate unit 4. The refrigerant flows from the first connecting pipes P411, P412, P413, and P414, flows through the first branch pipes P415, P416, P417, and P418, and flows into the driving flow inlet 41*a* of the ejector 41 via the intermediate second check valves V415, V416, V417, and V418. The refrigerant discharged from the discharge port 41*c* of the ejector 41 flows into the refrigerant inlet 42*a* of the gas-liquid separator 42. The refrigerant flowing out from the liquid-side outlet 42*b* of the gas-liquid separator 42 flows into the intermediate fourth pipe P44, flows into the intermediate third pipe P43 via the intermediate fourth on-off valve V44, and flows toward the switching mechanism 43. The refrigerant flows out from the intermediate unit 4 via the switching mechanism 43.

The refrigerant flowing out from the intermediate unit 4 is sent to the heat-source-side unit 2 through the second connection pipe 6. The refrigerant sent to the heat-source-side unit 2 is sent to the heat-source-side heat exchanger 23 via the heat-source-side fourth check valve V24. The refrigerant is heated by exchanging heat with the outdoor air and is evaporated in the heat-source-side heat exchanger 23 that functions as the evaporator of the refrigerant. The evaporated refrigerant is sucked into the compressor 21 via the switching mechanism 22.

In this way, during the heating only operation described above, the refrigerant is returned to the compressor 21 through the second connection pipe 6 without being pressurized in the ejector 41.

(4) Features

An air conditioner 1 according to one or more embodiments includes a heat-source-side unit 2, a plurality of use-side units 3*a*, 3*b*, 3*c*, and 3*d*, an intermediate unit 4, and two connection pipes 5 and 6. The heat-source-side unit 2 has a compressor 21 and a heat-source-side heat exchanger 23. The plurality of use-side units 3*a*, 3*b*, 3*c*, and 3*d* have use-side heat exchangers 31*a*, 31*b*, 31*c*, and 31*d*. The intermediate unit 4 switches each of the plurality of use-side heat exchangers 31*a*, 31*b*, 31*c*, and 31*d* to individually function as the evaporator or the radiator of the refrigerant. The two connection pipes 5 and 6 connect the heat-source-side unit 2 and the intermediate unit 4. The intermediate unit 4 has an ejector 41 and a gas-liquid separator 42. The ejector 41 pressurizes the refrigerant evaporated in the evaporator by using a driving flow. The refrigerant flowing out from the ejector 41 flows into the gas-liquid separator 42. The ejector 41 functions in a cooling-heating mixed operation mainly for cooling (cooling main operation) in which a sum of cooling operation loads of the plurality of use-side units 3*a*, 3*b*, 3*c*, and 3*d* is greater than a sum of heating operation loads of the plurality of use-side units 3*a*, 3*b*, 3*c*, and 3*d*.

Hence, as illustrated in FIG. 5, the ejector 41 functions in the cooling-heating mixed operation mainly for cooling in which the sum of the cooling operation loads of the plurality of use-side units 3*a*, 3*b*, 3*c*, and 3*d* is greater than the sum of the heating operation loads of the plurality of use-side units 3*a*, 3*b*, 3*c*, and 3*d*. Accordingly, the ejector 41 can be used during the cooling main operation. Thus, the air conditioner 1 according to one or more embodiments can recover power during the cooling main operation.

The air conditioner 1 according to one or more embodiments further includes a first pipe (in this case, constituted by first connecting pipes P411, P412, P413, and P414, third connection pipes 51, 52, 53, and 54, and use-side first pipes P31*a*, P31*b*, P31*c*, and P31*d*) and a second pipe (in this case, first branch pipes P415, P416, P417, and P418). The first pipe connects the use-side heat exchangers 31*a*, 31*b*, 31*c*, and 31*d* and the gas-liquid separator 42. The second pipe branches off from the first pipe and guides the refrigerant to a driving flow inlet 41*a* of the ejector 41.

The second pipe branching off from the first pipe can increase the flow rate of the driving flow of the ejector 41. Thus, it is possible to effectively suppress a decrease in the pressure of the refrigerant flowing from the intermediate unit 4 to the heat-source-side unit 2.

In the air conditioner 1 according to one or more embodiments, the ejector 41 further functions in at least one of a cooling only operation in which all of the plurality of use-side units 3*a*, 3*b*, 3*c*, and 3*d* perform cooling, and a cooling-heating equivalent operation in which a sum of cooling operation loads and a sum of heating operation loads of the plurality of use-side units 3*a*, 3*b*, 3*c*, and 3*d* are equivalent.

Hence, the ejector 41 further functions in the at least one of the cooling only operation and the cooling-heating equivalent operation. Accordingly, the ejector 41 can be further used in the at least one of the cooling only operation and the cooling-heating equivalent operation in addition to the cooling-heating mixed operation mainly for cooling (cooling main operation). Thus, the air conditioner 1 according to one or more embodiments can recover power during the at least one of the cooling only operation and the cooling-heating equivalent operation in addition to the cooling main operation.

The air conditioner 1 according to one or more embodiments further includes a third pipe (in this case, third branch pipe P432) that allows the refrigerant evaporated in the evaporator to be sucked into the ejector 41. The third branch pipe P432 serving as the third pipe is provided with an on-off valve (in this case, intermediate third on-off valve V432). The connection pipes have a low-pressure-side gas connection pipe (in this case, second connection pipe 6) that connects the heat-source-side unit 2 and the intermediate unit 4. The intermediate unit 4 further has a switching mechanism 43 that switches between a path of the refrigerant flowing from an outlet of the evaporator to the second connection pipe 6 serving as the gas connection pipe and a path of the refrigerant flowing from a gas-side outlet 42*c* of the gas-liquid separator 42 to the second connection pipe 6 serving as the gas connection pipe. The air conditioner 1 further includes a control unit 70 that controls the intermediate third on-off valve V432 serving as the on-off valve and the switching mechanism 43.

As illustrated in FIG. 5, when the control unit 70 opens the intermediate third on-off valve V432 and switches the switching mechanism 43 so that the refrigerant flows from the gas-side outlet 42*c* of the gas-liquid separator 42 to the second connection pipe 6, the ejector 41 functions during the cooling-heating mixed operation mainly for cooling. In contrast, as illustrated in FIG. 6, when the control unit 70 closes the intermediate third on-off valve V432 and switches the switching mechanism so that the refrigerant flows from the outlet of the evaporator to the second connection pipe 6, the ejector 41 does not function during the cooling-heating mixed operation mainly for cooling. Thus, it is possible to select whether to cause the ejector 41 to function or to cause the ejector 41 not to function during the cooling-heating mixed operation mainly for cooling.

In the air conditioner 1 according to one or more embodiments, the ejector is configured not to function in a heating only operation in which all of the plurality of use-side units 3*a*, 3*b*, 3*c*, and 3*d* perform heating, and in a cooling-heating mixed operation mainly for heating (heating main operation) in which a sum of heating operation loads of the plurality of use-side units 3*a*, 3*b*, 3*c*, and 3*d* is greater than a sum of cooling operation loads of the plurality of use-side units 3*a*, 3*b*, 3*c*, and 3*d*.

Since the advantage of using the ejector 41 is small in the heating only operation and the heating main operation, the ejector 41 is configured not to function in the heating only operation and the heating main operation as illustrated in FIGS. 9 and 10.

The compressor 21 according to one or more embodiments discharges the refrigerant in a supercritical state. Accordingly, since the refrigerant in the supercritical state flows through a part of the intermediate unit 4, the refrigerant in the supercritical state can be used as the driving flow. Thus, the effect of using the ejector 41 can be enhanced.

The refrigerant to be compressed in the compressor 21 according to one or more embodiments contains carbon dioxide. Accordingly, the refrigerant containing carbon dioxide can be brought into the supercritical state. Thus, it is possible to easily implement the air conditioner in which the effect of using the ejector 41 is enhanced.

(5) Modifications (5-1) Modification A

In the above-described embodiments, the first branch pipes P415, P416, P417, and P418 are provided in the intermediate unit 4; however, at least a part of the first branch pipes P415, P416, P417, and P418 may constitute the third connection pipes 51, 52, 53, and 54. In the present modification, the first branch pipes P415, P416, P417, and P418 respectively branch off from the third connection pipes 51, 52, 53, and 54.

(5-2) Modification B

In the above-described embodiments, it is configured such that the refrigerant that has radiated heat in the use-side units 3*a*, 3*b*, 3*c*, and 3*d* that perform the heating operation flows in from the driving flow inlet 41*a* of the ejector 41, and a suction flow does not flow to the suction flow inlet 41*b*; however, it is not limited thereto. In the present modification, it is configured such that the refrigerant that has radiated heat in the use-side units 3*a*, 3*b*, 3*c*, and 3*d* that perform the heating operation does not pass through the ejector 41.

(5-3) Modification C

In the air conditioner 1 according to the above-described embodiments, carbon dioxide is used as the refrigerant. As the refrigerant used in the air conditioner, carbon dioxide or a mixed refrigerant containing carbon dioxide may be used because such a refrigerant has a high pressure when discharged from the compressor 21. However, it is not limited thereto, and a refrigerant other than the refrigerant of carbon dioxide or the mixed refrigerant containing carbon dioxide may be used. For example, a refrigerant having a saturation pressure of 4.5 MPa or more when the saturation temperature reaches 65° C. may be used. As such a refrigerant, for example, R410A can be used. Alternatively, a fluorocarbon-based refrigerant that is in a critical state when discharged from the compressor 21 may be used. As such a fluorocarbon-based refrigerant, for example, R23 can be used.

(5-4) Modification D

Figure 11:
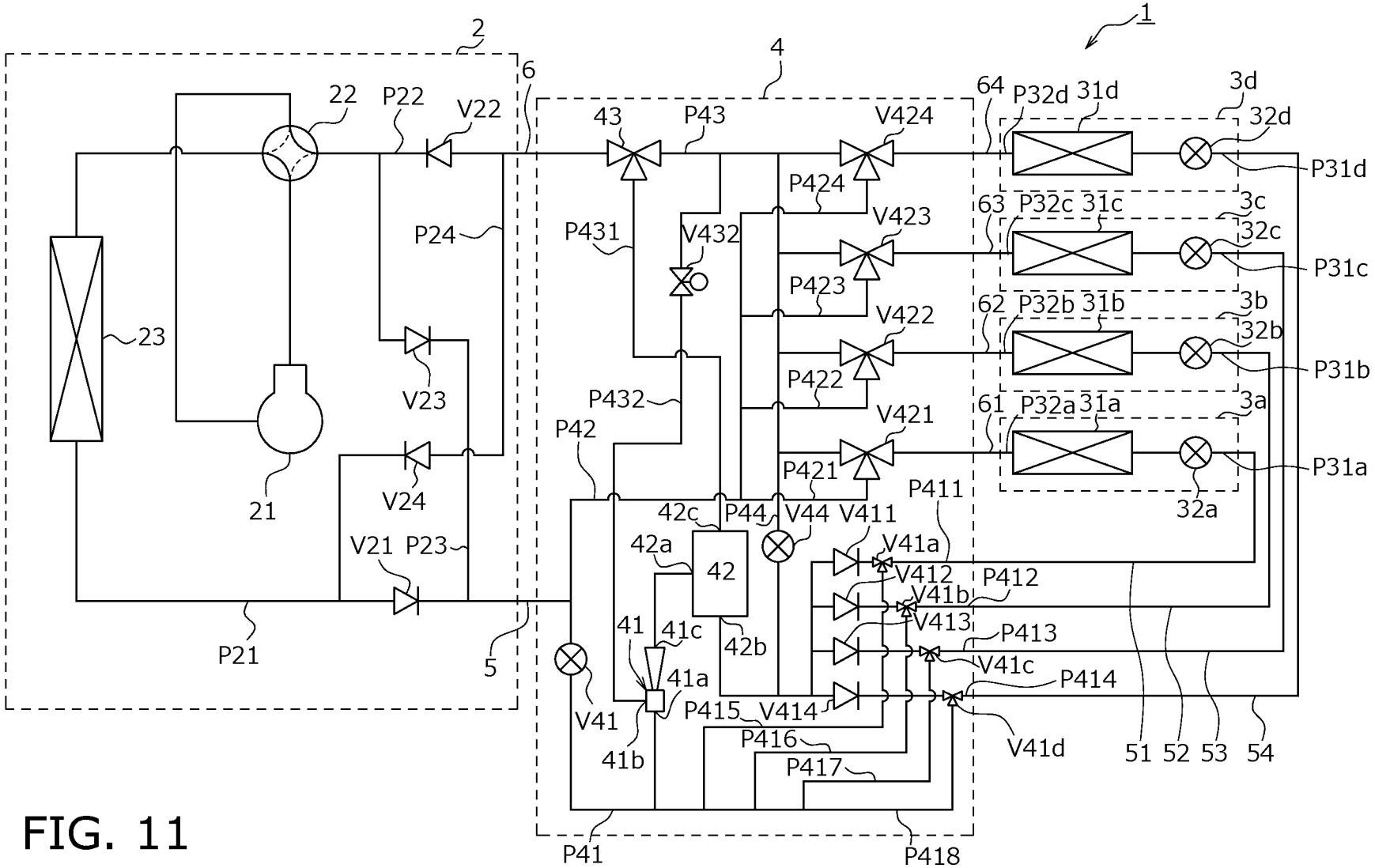
FIG. 11 is a schematic configuration diagram of an air conditioner according to a modification of the present disclosure.

In the above-described embodiments, while the intermediate first check valves V411, V412, V413, and V414 are provided in the first connecting pipes P411, P412, P413, and P414, the intermediate first check valves V411, V412, V413, and V414 may be electric valves or may be omitted. Also, in the above-described embodiments, while the intermediate second check valves V415, V416, V417, and V418 are provided in the first branch pipes P415, P416, P417, and P418, the intermediate second check valves V415, V416, V417, and V418 may be electric valves or may be omitted. In the present modification, as illustrated in FIG. 11, three-way valves V41*a*, V41*b*, V41*c*, V41*d* are provided at connecting portions between the first connecting pipes P411, P412, P413, and P414 and the first branch pipes P415, P416, P417, and P418.

(5-5) Modification E

In the above-described embodiments, the intermediate unit 4 has one ejector 41; however, may have a plurality of ejectors 41. Further, in the above-described embodiments, the air conditioner 1 includes one intermediate unit 4; however, may include a plurality of intermediate units 4.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioner
2 heat-source-side unit
3*a*, 3*b*, 3*c*, 3*d* use-side unit
4 intermediate unit
5, 6, 51, 52, 53, 54, 61, 62, 63, 64 connection pipe
21 compressor
23 heat-source-side heat exchanger
31*a*, 31*b*, 31*c*, 31*d* use-side heat exchanger
P31*a*, P31*b*, P31*c*, P31*d* use-side first pipe
41 ejector
41*a* driving flow inlet
41*b* suction flow inlet
41*c* discharge port
42 gas-liquid separator
42*a* refrigerant inlet
42*b* liquid-side outlet
42*c* gas-side outlet
43 switching mechanism
70 control unit
P411, P412, P423, P414 first connecting pipe
P415, P416, P417, P418 first branch pipe
P432 third branch pipe
V432 third on-off valve

PATENT LITERATURE

PTL 1: Japanese Unexamined Patent Application Publication No. 2016-70595

What is claimed is:

1. An air conditioner comprising:
a heat-source-side unit comprising:
a compressor; and
a heat-source-side heat exchanger;
use-side units each comprising a use-side heat exchanger;
an intermediate unit that causes the use-side heat exchanger of each of the use-side units to individually function as an evaporator or a radiator; and
two connection pipes that each connect the heat-source-side unit and the intermediate unit, wherein
the intermediate unit is configured such that refrigerants, each of which evaporates in the use-side heat exchanger that is functioning as an evaporator, flow out from corresponding use-side units and merge,
the intermediate unit comprises:
an ejector that pressurizes the merged refrigerants by using a driving flow in a cooling main operation of a cooling-heating mixed operation in which a sum of cooling operation loads of the use-side units is greater than a sum of heating operation loads of the use-side units; and
a gas-liquid separator into which the merged refrigerants from the ejector flows, and
the intermediate unit is further configured such that the compressor sucks in the pressurized refrigerant.

2. The air conditioner according to claim 1, further comprising:
a first pipe that connects the use-side heat exchanger of one of the use-side units and the gas-liquid separator; and
a second pipe that branches off from the first pipe and that guides the refrigerant to an inlet of the driving flow of the ejector.

3. The air conditioner according to claim 1, wherein the ejector pressurizes the refrigerant in one or both of:

a cooling only operation in which all of the use-side units perform cooling, and a cooling-heating equivalent operation in which the sum of the cooling operation loads is equal to the sum of the heating operation loads.

4. The air conditioner according to claim 1, further comprising:

a pipe that allows the refrigerant evaporated in the use-side heat exchanger that is functioning as the evaporator to be sucked into the ejector, wherein the pipe comprises an on-off valve, one of the two connection pipes is a low-pressure-side gas connection pipe, the intermediate unit further comprises a switching mechanism that switches a path of the refrigerant between:

a path flowing from an outlet of the use-side heat exchanger that is functioning as the evaporator to the low-pressure-side gas connection pipe, and a path from a gas-side outlet of the gas-liquid separator to the low-pressure-side gas connection pipe, and the air conditioner further comprises a controller that controls:

the on-off valve, and the switching mechanism.

5. The air conditioner according to claim 1, wherein the ejector is configured not to function in response to one or both of:

all of the use-side units performing heating, and the sum of the heating operation loads being greater than the sum of the cooling operation loads.

6. The air conditioner according to claim 1, wherein the compressor discharges the refrigerant in a supercritical state.

7. The air conditioner according to claim 6, wherein the refrigerant comprises carbon dioxide.

8. The air conditioner according to claim 1, further comprising a pipe that guides the refrigerant flowing out from the use-side units performing heating operation to an inlet of the ejector for the driving flow in the cooling main operation of the cooling-heating mixed operation.

9. An air conditioner comprising:

a heat-source-side unit comprising:

a compressor; and a heat-source-side heat exchanger;

use-side units each comprising a use-side heat exchanger;

an intermediate unit that causes the use-side heat exchanger of each of the use-side units to individually function as an evaporator or a radiator of a refrigerant; and two connection pipes that each connect the heat-source-side unit and the intermediate unit, wherein the intermediate unit comprises:

an ejector that pressurizes the refrigerant evaporated in the use-side heat exchanger that is functioning as an evaporator by using a driving flow; and a gas-liquid separator into which the refrigerant flowing out from the ejector flows, the ejector pressurizes the refrigerant in a cooling main operation of a cooling-heating mixed operation in which a sum of cooling operation loads of the use-side units is greater than a sum of heating operation loads of the use-side units, the air conditioner further comprises a pipe that allows the refrigerant evaporated in the use-side heat exchanger that is functioning as the evaporator to be sucked into the ejector, the pipe comprises an on-off valve, one of the two connection pipes is a low-pressure-side gas connection pipe, the intermediate unit further comprises a switching mechanism that switches a path of the refrigerant between:

a path flowing from an outlet of the use-side heat exchanger that is functioning as the evaporator to the low-pressure-side gas connection pipe, and a path from a gas-side outlet of the gas-liquid separator to the low-pressure-side gas connection pipe, and the air conditioner further comprises a controller that controls:

the on-off valve, and the switching mechanism.

* * * * *